US005743962A

United States Patent [19]

Ogasawara et al.

[11] Patent Number: 5,743,962

[45] Date of Patent: Apr. 28, 1998

[54] PRODUCT CONVEYING SYSTEM FOR COATING AND TREATING SURFACES

[75] Inventors: Toshifumi Ogasawara; Shinji Katayama, both of Hiroshima-ken, Japan

[73] Assignee: Mazda Motor Corporation, Japan

[21] Appl. No.: 823,483

[22] Filed: Mar. 25, 1997

Related U.S. Application Data

[62] Division of Ser. No. 627,252, Apr. 3, 1996, Pat. No. 5,651,820, which is a continuation of Ser. No. 312,801, Sep. 27, 1994, abandoned.

[30] Foreign Application Priority Data

Sep. 30, 1993 [JP] Japan ..... 5-268455
Jul. 7, 1994 [JP] Japan ..... 6-156131

[51] Int. Cl.[6] ..... B05B 13/00

[52] U.S. Cl. ..... 118/643; 118/58; 118/66; 118/320; 118/322; 118/324; 198/347.4; 198/465.2; 104/88.02; 104/88.03; 104/88.05; 104/104

[58] Field of Search ..... 118/58, 56, 66, 118/320, 322, 324, 642, 643; 198/347.4, 465.2; 104/104, 88.02, 88.03, 88.05

[56] References Cited

U.S. PATENT DOCUMENTS

| | | | |
|---|---|---|---|
| 2,640,580 | 6/1953 | Burgh | 198/465.2 |
| 3,323,633 | 6/1967 | Engel et al. | 198/461 |
| 3,592,141 | 7/1971 | Davidson | 104/88.02 |
| 3,737,019 | 6/1973 | Coleman et al. | 198/459 |
| 4,564,100 | 1/1986 | Moon | 198/465.1 |
| 4,615,274 | 10/1986 | Hoehn | 198/465.1 |
| 4,761,894 | 8/1988 | Hamasaki et al. | 118/58 |
| 4,770,122 | 9/1988 | Ichihashi et al. | 104/88.03 |
| 4,827,598 | 5/1989 | Sakamoto et al. | 198/465.1 |
| 4,874,639 | 10/1989 | Matsui et al. | 427/240 |
| 4,908,231 | 3/1990 | Nelson et al. | 118/642 |
| 4,951,802 | 8/1990 | Weissgerber et al. | 198/465.1 |
| 4,967,487 | 11/1990 | Urquahart | 118/642 |
| 5,115,758 | 5/1992 | Suzuki et al. | 118/642 |
| 5,149,371 | 9/1992 | Tateuchi et al. | 118/66 |
| 5,282,145 | 1/1994 | Lipson et al. | 118/642 |
| 5,401,534 | 3/1995 | Faraoni et al. | 118/58 |

FOREIGN PATENT DOCUMENTS

| | | |
|---|---|---|
| 4115111 | 11/1991 | Germany . |
| 4114757 | 4/1992 | Japan . |
| 4227885 | 8/1992 | Japan . |
| 6015215 | 1/1994 | Japan . |
| 3001892 | 2/1993 | WIPO . |

*Primary Examiner*—Laura Edwards
*Attorney, Agent, or Firm*—Sixbey, Friedman, Leedom & Ferguson, P.C.; Gerald J. Ferguson, Jr.; Tim L. Brackett, Jr.

[57] ABSTRACT

A work is applied with a solvent-containing thermosetting coating composition to a thickness larger than a limit thickness over which the coating composition on a surface of the work extending in a vertical direction will normally run or sag in a coating zone. After applied with the coating composition, the work is rotated about a substantially horizontal axis to prevent the coating composition on the vertical surface of the work from running or sagging and is conveyed through a heat-hardening zone for hardening the coating composition applied to the work by heating by a conveyor line. The conveyor line includes a pair of conveyors which are separated from each other upstream of a position where the coating composition is applied to the work to a thickness larger than said limit thickness. The heat-hardening zone includes a pre-heat-hardening zone for half hardening the coating composition and a main heat-hardening zone for fully hardening the coating composition after the coating composition is half hardened. A pooling zone in which a predetermined number of works can be temporarily pooled is provided between the pre-heat-hardening zone and the main heat-hardening zone.

27 Claims, 12 Drawing Sheets

PRODUCT CONVEYING SYSTEM FOR COATING AND TREATING SURFACES

This is a divisional application of Ser. No. 08/627,252, filed Apr. 3, 1996 now U.S. Pat. No. 5,651,820 which is a continuation application of Ser. No. 08/312,801 filed Sep. 27, 1994, now abandoned.

BACKGROUND OF THE INVENTION

1. Field of the Invention

This invention relates to a coating apparatus for coating a surface of a work, and more particularly to a rotational coating apparatus in which a coating composition is applied to the surface of a work to a thickness larger than a limit thickness of running or sagging and the work is rotated about a substantially horizontal axis in order to prevent running or sagging of the coating composition.

2. Related Art

It has been known that when a work such as a vehicle body is coated with a coating composition, the smoothness of the coating film surface can be improved by increasing the amount of coating composition to increase the thickness of the coating film.

That is, when a coating composition is applied to the surface of a work, the surface of the coating film tends to become smooth due to its surface tension which acts on the surface of coating film as a tensile force in a direction parallel to the surface of the coating film. The smoothening effect by the surface tension becomes better as the flowability of the coating composition increases. The flowability of the coating composition increases with increase in the amount of coating composition (the thickness of the coating film). Accordingly, when the amount of the coating composition is increased, the flowability of the coating composition increases and the smoothness of the coating film becomes better. Especially when the coating composition is applied to a thickness larger than a limit thickness of running or sagging, the surface of the coating film becomes excellently smooth. The "limit thickness of running or sagging" means a minimum thickness of the coating film over which running or sagging of the coating composition will occur and will be referred to simply as "the running limit thickness", hereinbelow.

When the coating composition is applied to a work having a surface extending substantially in a vertical direction to a thickness larger than the running limit thickness, sagging or running of the coating composition occurs in the vertical surface of the work under gravity, which greatly deteriorates the smoothness of the coating film.

However when the work is rotated about a horizontal axis after application of the coating composition, a force in a direction opposite to the gravity acts on the coating composition on the vertical surface and sagging or running of the coating composition can be prevented. Further a tensile force which acts on the coating composition in a direction parallel to the surface of the coating film is generated by the rotation of the work, and the tensile force is associated with the surface tension of the coating composition to further smoothen the surface of the coating film.

Recently, as disclosed for instance in U.S. Pat. No. 4,874,639, there has been proposed a method of coating which is called "rotational coating method" and in which a coating composition is applied to the surface of a work to a thickness larger than a running limit thickness and the work applied with the coating composition is rotated about a substantially horizontal axis to prevent running or sagging of the coating composition from a time before the coating composition begins to run or sag until the coating composition sets to such an extent that the coating composition cannot run or sag, thereby obtaining a sufficient thickness of coating film to improve smoothness of the coating film surface while preventing running or sagging of the coating composition.

In the rotational coating apparatus, a thermosetting coating composition containing therein a solvent is generally used, and the rotational coating apparatus generally comprises a coating station including a coating zone for applying the coating composition to a work to a thickness larger than a limit thickness over which the coating composition on a surface of the work extending in a vertical direction will normally run or sag, a setting station including a setting zone for evaporating the solvent in the coating composition applied to the work (the setting zone is sometimes omitted) and a heat-hardening station including a heat-hardening zone for hardening the coating composition by heating after the setting in the setting zone, a rotating means for rotating the work about a substantially horizontal axis after the coating in the coating zone to prevent the coating composition on the vertical surface of the work from running or sagging until the coating composition comes into such a state that running or sagging cannot occur, and a conveyor means for passing the work through the coating zone, the setting zone and the heat-hardening zone in this order.

The coating composition is applied to the work in a plurality of times and is generally applied to a thickness larger than the running limit thickness in the final coating zone. For example, when the coating zone comprises first and second coating zones respectively for effecting first coating and second coating, the coating composition is applied to a thickness smaller than the running limit thickness in the first coating zone and then is applied to a thickness larger than the running limit thickness in the second coating zone.

In such a case, when the conveyor means comprises a single conveyor, the following problem is involved. That is, when some trouble, such as failure in a coating robot or the conveyor, occurs in a part of the coating line upstream of the zone where the coating composition is applied to a thickness larger than the running limit thickness (e.g., the second coating zone) and the coating line is stopped, said single conveyor is stopped in whole and accordingly the work which has been applied with the coating composition to a thickness larger than the running limit thickness is stopped there, which results in run or sag of the coating composition and defect in coating.

In order to avoid the problem, it has been proposed to separate the conveyor line between the first coating zone and the second coating zone and to drive the first conveyor on the side of the first coating zone and the second conveyor on the side of the second coating zone separately from each other as disclosed, for instance, in Japanese Unexamined Patent Publication No. 4(1992)-114757. This arrangements permits the second conveyor to continuously convey the work which has been applied with the coating composition in a thickness larger than the running limit thickness into the zones where the work is rotated and running or sagging of the coating composition is prevented (e.g., the setting zone and/or the heat-hardening zone) even if some trouble occurs in the first coating zone or the coating line upstream thereof.

Since the rotational coating apparatus is for obtaining a coating of high quality having a extremely smooth coating film surface, it is required a high provision against reduction in smoothness of the coating film surface due to running or sagging generated by trouble in the coating line or the like and reduction in the coating quality due to adhesion of dust or the like.

From this viewpoint, the conventional rotational coating apparatus where the conveyor line is separated between the first coating zone and the second coating zone still has the following problem.

That is, some trouble can occur in the downstream side of the second coating zone. In this case, though it is needless to say that the work cannot be conveyed downstream of the part of the trouble, it can be possible to convey the work which has been applied to a thickness larger than the running limit thickness out the second coating zone into the rotating zones where the work is LO rotated and running or sagging of the coating composition is prevented (e.g., the setting zone and/or the heat-hardening zone) or a position where the coating composition has come into such a state that running or sagging cannot occur, so long as the part of the trouble is downstream of the rotating zones and the position where the coating composition has come into such a state that running or sagging cannot occur and the conveyor itself can convey the work downstream from the second coating zone.

However when the conveyor downstream of the second coating zone is filled with the works, the work in the second coating zone cannot be conveyed out the second coating zone and must stay there, which results in running of sagging of the coating composition and defect in coating.

Further in the rotary coating line, the work is generally conveyed on a rotary truck and is rotated on the rotary truck in the zones where running or sagging can occur. When dust and the like are on the rotary truck, the dust and the like fly and adhere to the coating film surface when the work is rotated, which results in a low quality of coating. Further when the mechanism for rotating the work gets trouble and the work cannot be rotated in a proper manner, the smoothness of the coating film surface deteriorates.

SUMMARY OF THE INVENTION

In view of the foregoing observations and description, the primary object of the present invention is to provide a rotational coating apparatus which can overcome the problem of running or sagging of the coating composition due to trouble in the coating line especially downstream of the coating zone where the coating composition is applied to the work to a thickness larger than the running limit thickness and can constantly provide an extremely smooth coating film surface.

Another object of the present invention is to provide a rotational coating apparatus which can overcome the problem of defect in coating due to dust or the like on the rotary truck and/or trouble in the mechanism for rotating the work and can constantly provide an extremely smooth coating film surface.

Rotational coating apparatus in accordance with a first aspect of the present invention In accordance with a first aspect of the present invention there is provided a rotational coating apparatus comprising a coating station including a coating zone for applying a solvent-containing thermosetting coating composition to a work to a thickness larger than a limit thickness over which the coating composition on a surface of the work extending in a vertical direction will normally run or sag a heat-hardening station including, a heat-hardening zone for hardening the coating composition applied to the work by heating, a rotating means for rotating the work about a substantially horizontal axis after the coating in the coating zone to prevent the coating composition on the vertical surface of the work from running or sagging, and a conveyor means for passing the work through the coating zone and the heat-hardening zone in this order, the conveyor means including a pair of conveyors which form a conveyor line and are separated from each other upstream of a position where the coating composition is applied to the work to a thickness larger than said limit thickness, and said heat-hardening zone including a pre-heat-hardening zone for half hardening the coating composition and a main heat-hardening zone for fully hardening the coating composition after the coating composition is half hardened, wherein the improvement comprises that a pooling station including a pooling zone in which a predetermined number of works can be temporarily pooled is provided between the pre-heat-hardening zone and the main heat-hardening zone.

The conveyor for passing the work through the coating zone and the pre-heat-hardening zone in this order may comprise a rotary conveyor which conveys the work on a rotary truck which carries the work supporting it for rotation, and the conveyor for passing the work through the main heat-hardening zone may comprise a non-rotary conveyor which conveys the work on a non-rotary truck which carries the work holding it stationary, and a transfer means for transferring the work on the rotary truck on the rotary conveyor to the non-rotary truck on the non-rotary conveyor may be provided between the pre-heat-hardening zone and the main heat-hardening zone. In this case, said pooling zone may be provided between the pre-heat-hardening zone and the transfer means or between the transfer means and the main heat-hardening zone.

Said rotating means may comprise a rotation transmitting mechanism provided on the rotary truck and a sub conveyor which is provided along the rotary conveyor to provide rotation to the rotation transmitting mechanism. The rotary conveyor may be formed in an endless fashion.

For example, the pooling zone may be formed by separating the conveyor line upstream of the position where the pooling zone is to be provided and making the conveying rate (the number of trucks which can be conveyed in a unit time) higher in the downstream side conveyor line than in the upstream side conveyor line. In this case, the pooling zone is provided on the downstream side conveyor line itself. Otherwise the pooling zone may comprise a pooling conveyor connected to the conveyor line.

The pooling zone should be able to accommodate at least the same number of works as that of the works in the zone where the coating composition is applied to the work to a thickness larger than said limit thickness. Also the pooling zone may be arranged to accommodate at least the same number of works as the sum of the numbers of the works in the zone where the coating composition is applied to the work to a thickness larger than said limit thickness and the setting zone. Further the pooling zone may be arranged to accommodate at least the same number of works as the sum of the numbers of the works in the zone where the coating composition is applied to the work to a thickness larger than said limit thickness, the setting zone and the pre-heat-hardening zone.

In the pre-heat-hardening zone, the coating composition may be half-hardened by a far-infrared oven and in the main heat-hardening zone, the coating composition may be fully hardened by a hot-air oven.

The coating in the coating zone may be for forming the topcoating film. The coating zone may comprise a plurality of zones so that the coating composition is applied to the work to a thickness larger than said limit thickness in the last zone. The coating in the coating zone may be for forming a clear coating film. The work may be a vehicle body.

Rotational coating apparatus in accordance with a second aspect of the present invention In accordance with a second aspect of the present invention there is provided a rotational coating apparatus comprising a coating zone for applying a solvent-containing thermosetting coating composition to a work to a thickness larger than a limit thickness over which the coating composition on a surface of the work extending in a vertical direction will normally run or sag, a setting zone for effecting setting of evaporating the solvent in the coating composition applied to the work to such an extent that the coating composition cannot run or sag, a heat-hardening zone for hardening the coating composition applied to the work by heating after the setting in the setting zone, a rotating means for rotating the work about a substantially horizontal axis after the coating in the coating zone to prevent the coating composition on the vertical surface of the work from running or sagging, and a conveyor means for passing the work through the coating zone, the setting zone and the heat-hardening zone in this order, the conveyor means including a pair of conveyors which form a conveyor line and are separated from each other upstream of a position where the coating composition is applied to the work to a thickness larger than said limit thickness, wherein the improvement comprises that a pooling zone in which a predetermined number of works can be temporarily pooled is provided between the setting zone and the heat-hardening zone.

The conveyors may comprise a rotary conveyor which conveys the work on a rotary truck which carries the work supporting it for rotation. Said rotating means may comprise a rotation transmitting mechanism provided on the rotary truck and a sub conveyor which is provided along the rotary conveyor to provide rotation to the rotation transmitting mechanism.

For example, the pooling zone may be formed by separating the conveyor line upstream of the position where the pooling zone is to be provided and making the conveying rate (the number of trucks which can be conveyed in a unit time) higher in the downstream side conveyor line than in the upstream side conveyor line. In this case, the pooling zone is provided on the downstream side conveyor line itself. Otherwise the pooling zone may comprise a pooling conveyor connected to the conveyor line.

The pooling zone should be able to accommodate at least the same number of works as that of the works in the zone where the coating composition is applied to the work to a thickness larger than said limit thickness. Also the pooling zone may be arranged to accommodate at least the same number of works as the sum of the numbers of the works in the zone where the coating composition is applied to the work to a thickness larger than said limit thickness and the setting zone.

The coating in the coating zone may be for forming the topcoating film. The coating zone may comprise a plurality of zones so that the coating composition is applied to the work to a thickness larger than said limit thickness in the last zone. The coating in the coating zone may be for forming a clear coating film. The work may be a vehicle body.

Rotational coating apparatus in accordance with a third aspect of the present invention In accordance with a third aspect of the present invention there is provided a rotational coating apparatus comprising a coating zone for applying a solvent-containing thermosetting coating composition to a work to a thickness larger than a limit thickness over which the coating composition on a surface of the work extending in a vertical direction will normally run or sag, a heat-hardening zone for hardening the coating composition applied to the work by heating, a rotating means for rotating the work about a substantially horizontal axis after the coating in the coating zone to prevent the coating composition on the vertical surface of the work from running or sagging, and a conveyor means for passing the work through the coating zone and the heat-hardening zone in this order, the conveyor means including a pair of conveyors which form a conveyor line and are separated from each other upstream of a position where the coating composition is applied to the work to a thickness larger than said limit thickness, and said heat-hardening zone including a pre-heat-hardening zone for half-hardening the coating composition and a main heat-hardening zone for fully hardening the coating composition after the coating composition is half-hardened, wherein the improvement comprises that the conveyor for passing the work through the coating zone and the pre-heat-hardening zone in this order comprises a rotary conveyor which is formed in an endless fashion and conveys the work on a rotary truck which carries the work supporting it for rotation while the conveyor for passing the work through the main heat-hardening zone comprises a non-rotary conveyor which conveys the work on a non-rotary truck which carries the work holding it stationary, a first transfer means for transferring the work to the rotary truck on the rotary conveyor in a position upstream of the coating zone and a second transfer means for transferring the work on the rotary truck on the rotary conveyor to the non-rotary truck on the non-rotary conveyor in a position downstream of the pre-heat-hardening zone and upstream of the first transfer means are provided, and a vacant truck changing station is provided on the rotary conveyor between the second transfer means and the first transfer means to transfer a vacant rotary truck from which the work has been removed by the second transfer means to a vacant truck maintenance station and to take out a vacant rotary truck which has been maintained from the vacant truck maintenance station.

The vacant truck maintenance station may comprise a maintenance conveyor formed in an endless fashion. The maintenance conveyor may be disposed on a floor different from the floor on which the rotary conveyor is disposed. The vacant truck maintenance station may comprise a lifter which conveys up and down the vacant rotary truck between the rotary conveyor and the maintenance conveyor to transfer the vacant rotary truck from the former to the latter and from the latter to the former. The maintenance conveyor may have a length sufficient to accommodate all the rotary trucks on the rotary conveyor.

General description about the first to third aspects of the present invention

In the present invention, a thermosetting coating composition containing therein a solvent is used as described above. As the solvent, aqueous solvents may be used as well as volatile solvents or organic solvents.

In this specification, that the coating composition runs or sags means that the coating composition runs or sags 2 mm or more. That is, to apply the coating composition to a thickness larger than the limit thickness over which the coating composition will normally run or sag is to provide a sufficient flowability to the coating composition so that a sufficient smoothness of the coating film surface can be obtained when the work is rotated, and in order to obtain a sufficient smoothness of the coating film surface, such a flowability that the coating composition can run or sag at least 2 mm is necessary.

That the coating composition on a vertical surface of the work will normally run or sag means that the coating composition on a vertical surface of the work will run or sag (2 mm or more) under the gravity if the vertical surface is kept vertical without being rotated. Said limit thickness over which the coating composition on a vertical surface of the work will normally run or sag means a minimum thickness at which the coating composition can run or sag and is substantially equivalent to aforesaid running limit thickness.

That the coating composition is applied to a work to a thickness larger than a limit thickness over which the coating composition on a surface of the work extending in a vertical direction will normally run or sag means that the coating composition is applied to the work in such a state that running or sagging of coating composition will occur in the vertical surface if the work is caused to stand without being rotated. Accordingly if the work is caused to stand without being rotated after the coating, the coating composition on the vertical surface runs or sags and in the case where the setting zone is provided, if the work is caused to stand without being rotated in the setting zone, the coating composition on the vertical surface runs or sags also in the setting zone.

When a typical thermosetting coating composition is heated, the solid component of the coating composition is once softened (reduction of viscosity) and the coating composition exhibits a high flowability and when further heated, the temperature of the coating composition exceeds its reaction starting temperature and the coating composition hardens by crosslinking reaction.

Accordingly, irrespective of whether the coating composition is in such a state that running or sagging can occur (will be referred to simply as "the running state", hereinbelow) or in such a state that running or sagging cannot occur (will be referred to simply as "the non-running state", hereinbelow) before the work is introduced into the heat-hardening zone, the solid component of the coating composition softened early in the heat-hardening and the flowability of the coating composition can increase to such an extent that running or sagging can occur.

That the work is rotated about a substantially horizontal axis after the coating step to prevent the coating composition on the vertical surface of the work from running or sagging means that the work is rotated not to permit the coating composition on the work to run or sag 2 mm or more and the work should be rotated at least from a time before the coating composition applied to the work runs or sags 2 mm to a time after which the coating composition runs or sags no more. The work should be rotated as long as the coating composition can run or sag, and preferably until the coating composition completely lose its flowability.

When the work applied with the coating composition is subjected to the heat-hardening step immediately after the coating step, the surface of the coating film is rapidly hardened with a large amount of the solvent remaining in the coating composition and when the solvent is subsequently released through the hardened surface film, holes can be generated in the surface of the coating film. In order to avoid this problem, the setting is effected to evaporate the solvent to some extent before the heat-hardening step. When the solvent is an organic solvent (volatile solvent), the setting step is effected by allowing the work to stand for a predetermined time at an ordinary temperature. When the solvent is an aqueous solvent, the setting step is effected by allowing the work to stand for a predetermined time at a temperature higher than ordinary temperatures, e.g., for 5 to 7 minutes at 80° C. Though the setting step may be effected at an elevated temperature also in the case of an organic solvent, the elevated temperature generally should be not higher than 40° C.

Though the present invention is basically directed to rotational coating in which the coating composition is applied to the work to a thickness larger than the running limit thickness and the work is rotated to prevent running or sagging of the coating composition and is directed to coating of a work having a surface extending substantially in a vertical direction, the present invention can also be applied to coating a work having no surface extending substantially in a vertical direction.

Description about the first aspect of the present invention

In the rotational coating apparatus in accordance with the first aspect of the present invention, the heat-hardening zone comprises the pre-heat-hardening zone and the main heat-hardening zone and the setting zone may be provided though not necessary.

In the case where the setting zone is provided, the coating composition is in "the running state" at least early in the setting step in the setting zone. In the heat-hardening zone especially in the pre-heat-hardening zone, the coating composition sometimes comes into the running state due to softening of the solid component as described above, and sometimes hardens as soon as heated without softening and do not come into the running state. When the setting zone is not provided, the coating composition should be in the running state in the pre-heat-hardening zone.

When the setting zone is provide, the work must be rotated as long as the coating composition is in the running state in the setting zone irrespective of whether the coating composition comes into the running state in the heat-hardening zone. When the coating composition can be in the running state in the pre-heat-hardening zone, the work must be rotated as long as the coating composition is in the running state in the pre-heat-hardening zone. When the coating composition cannot be in the running state in the pre-heat-hardening zone, the work need not be rotated in the pre-heat-hardening zone.

Description about the second aspect of the present invention

In the rotational coating apparatus in accordance with the second aspect of the present invention, the setting zone is provided and the solvent is evaporated in the setting to such an extent that the coating composition comes into the non-running state. The heat-hardening zone may be divided into the pre-heat-hardening zone and the main heat-hardening zone though not necessary.

In the rotational coating apparatus on accordance with the second aspect, the coating composition is in the running state at least early in the setting step in the setting zone. In the heat-hardening zone, the coating composition sometimes comes into the running state due to softening of the solid component as described above, and sometimes hardens as soon as heated without softening and do not come into the running state.

The work must be rotated as long as the coating composition is in the running state in the setting zone. When the coating composition can be in the running state in the heat-hardening zone, the work must be rotated as long as the coating composition is in the running state in the heat-hardening zone. When the coating composition cannot be in the running state in the heat-hardening zone, the work need not be rotated in the heat-hardening zone.

Description about the third aspect of the present invention

In the rotational coating apparatus in accordance with the third aspect of the present invention, the conveyor for passing the work through the coating zone and the pre-heat-hardening zone in this order comprises a rotary conveyor which is formed in an endless fashion and conveys the work on a rotary truck which carries the work supporting it for rotation, and the work is transferred to the rotary truck on the rotary conveyor by the first transfer means and is passed through the coating zone the pre-heat-hardening zone in this order, and then removed from the rotary conveyor by the second transfer means.

The rotational coating apparatus may be provided with the setting zone though not necessary. In the case where the setting zone is provided, the coating composition is in the running state at least early in the setting step in the setting zone. In the pre-heat-hardening zone especially, the coating composition sometimes comes into the running state due to softening of the solid component as described above, and sometimes hardens as soon as heated without softening and do not come into the running state. When the setting zone is not provided, the coating composition should be in the running state in the pre-heat-hardening zone.

When the setting zone is provide, the work must be rotated as long as the coating composition is in the running state in the setting zone irrespective of whether the coating composition comes into the running state in the heat-hardening zone. When the coating composition can be in the running state in the pre-heat-hardening zone, the work must be rotated as long as the coating composition is in the running state in the pre-heat-hardening zone. When the coating composition cannot be in the running state in the pre-heat-hardening zone, the work need not be rotated in the pre-heat-hardening zone.

Effect and Result of the Invention

As described above, in the rotational coating apparatus of the present invention, the conveyor line for conveying the work is separated upstream of a position where the coating composition is applied to the work to a thickness larger than the limit thickness, e.g., between the first coating zone and the second coating zone, and the first conveyor on the side of the first coating zone and the second conveyor on the side of the second coating zone are separately driven from each other.

This arrangements permits the second conveyor to continuously convey the work which has been applied with the coating composition in a thickness larger than the running limit thickness into the zones where the work is rotated and running or sagging of the coating composition is prevented (e.g., the setting zone and/or the heat-hardening zone) even if some trouble occurs in the first coating zone or the coating line upstream thereof. Accordingly, the problem that the work which has been applied with the coating composition to a thickness larger than the running limit thickness in the second coating zone is left there and the coating composition runs or sags can be avoided.

Some trouble can occur not only in the first coating zone or upstream thereof but also can occur in the downstream side of the second coating zone. In this case, though it is needless to say that the work cannot be conveyed downstream of the part of the trouble, it can be possible to convey the work which has been applied to a thickness larger than the running limit thickness out the second coating zone into the rotating zones where the work is rotated and running or sagging of the coating composition is prevented (e.g., the setting zone and/or the heat-hardening zone) or a position where the coating composition has come into such a state that running or sagging cannot occur, so long as the part of the trouble is downstream of the rotating zones and the position where the coating composition has come into such a state that running or sagging cannot occur and the conveyor itself can convey the work downstream from the second coating zone.

However when the conveyor downstream of the second coating zone is filled with the works, the work in the second coating zone cannot be conveyed out the second coating zone and must stay there, which results in running of sagging of the coating composition and defect in coating.

Further in the rotary coating line, the work is generally conveyed on a rotary truck and is rotated on the rotary truck in the zones where running or sagging can occur. When dust and the like are on the rotary truck, the dust and the like fly and adhere to the coating film surface when the work is rotated, which results in a low quality of coating. Further when the mechanism for rotating the work gets trouble and the work cannot be rotated in a proper manner, the smoothness of the coating film surface deteriorates.

The rotational coating apparatus in accordance with the first aspect

In the rotational coating apparatus of the first aspect, the heat-hardening zone includes a pre-heat-hardening zone for half-hardening the coating composition and a main heat-hardening zone for fully hardening the coating composition after the coating composition is half-hardened, and a pooling zone in which a predetermined number of works can be temporarily pooled is provided between the pre-heat-hardening zone and the main heat-hardening zone.

Accordingly, even if some trouble occurs downstream of the pooling zone, for instance, in the main heat-hardening zone or the inspecting zone or the assembly line downstream of the main heat-hardening zone and the conveyor line upstream of the position of trouble is filled with the works, the work in the coating zone (more strictly in the portion in the coating zone where the coating composition is applied to the thickness larger than the running limit thickness) can be conveyed out the coating zone into the rotating zone where the work is rotated to prevent running or sagging of the coating composition (the pre-heat-hardening zone in the case where the setting zone is not provided and the setting zone and/or the pre-heat-hardening zone when the setting zone is provided) by temporarily pooling the works in the pooling zone. Further when the work in the coating zone is passed through the pre-heat-hardening zone and the coating composition is half-hardened, the problem of adhesion of dust can be avoided.

The rotational coating apparatus in accordance with the second aspect

In the rotational coating apparatus of the second aspect, a setting zone for effecting setting of evaporating the solvent in the coating composition applied to the work to such an extent that the coating composition cannot run or sag is provided and a pooling zone in which a predetermined number of works can be temporarily pooled is provided between the setting zone and the heat-hardening zone.

Accordingly, even if some trouble occurs downstream of the pooling zone, for instance, in the main heat-hardening zone or the inspecting zone or the assembly line downstream of the main heat-hardening zone and the conveyor line upstream of the position of trouble is filled with the works, the work in the coating zone (more strictly in the portion in the coating zone where the coating composition is applied to the thickness larger than the running limit thickness) can be conveyed out the coating zone into the setting zone, where the work is rotated and running or sagging is prevented, or through the setting zone by temporarily pooling the works in the pooling zone. When the work is passed through the setting zone, the coating composition cannot run or sag no more.

The rotational coating apparatus in accordance with the third aspect

The rotational coating apparatus of the third aspect comprises an endless rotary conveyor for passing the work through the coating zone and the pre-heat-hardening zone, a first transfer means for transferring the work to the rotary conveyor in a position upstream of the coating zone, a second transfer means for transferring the work from the rotary conveyor in a position downstream of the pre-heat-hardening zone, and a vacant truck changing station provided on the rotary conveyor between the second transfer means and the first transfer means to transfer a vacant rotary truck from which the work has been removed by the second transfer means to a vacant truck maintenance station and to take out a vacant rotary truck which has been maintained from the vacant truck maintenance station.

The rotary truck which has passed through the coating zone and the pre-heat-hardening zone is transferred to the vacant truck maintenance station in the vacant truck changing station, is subjected to maintenance such as cleaning, upkeep, check and the like and then transferred again to the rotary conveyor. Thus is, the rotary truck is subjected to the maintenance every time it runs over the rotary conveyor, and then reused. Accordingly, the problem of defect in coating due to dust or the like on the rotary truck and/or trouble in the mechanism for rotating the work can be avoided and an extremely smooth coating film surface can be constantly obtained.

DESCRIPTION OF THE PREFERRED EMBODIMENT

A pair of embodiments of the present invention where the present invention is applied to coating of a vehicle body will be described with reference to the drawings, hereinbelow.

Coating of a vehicle body

Figure 1:
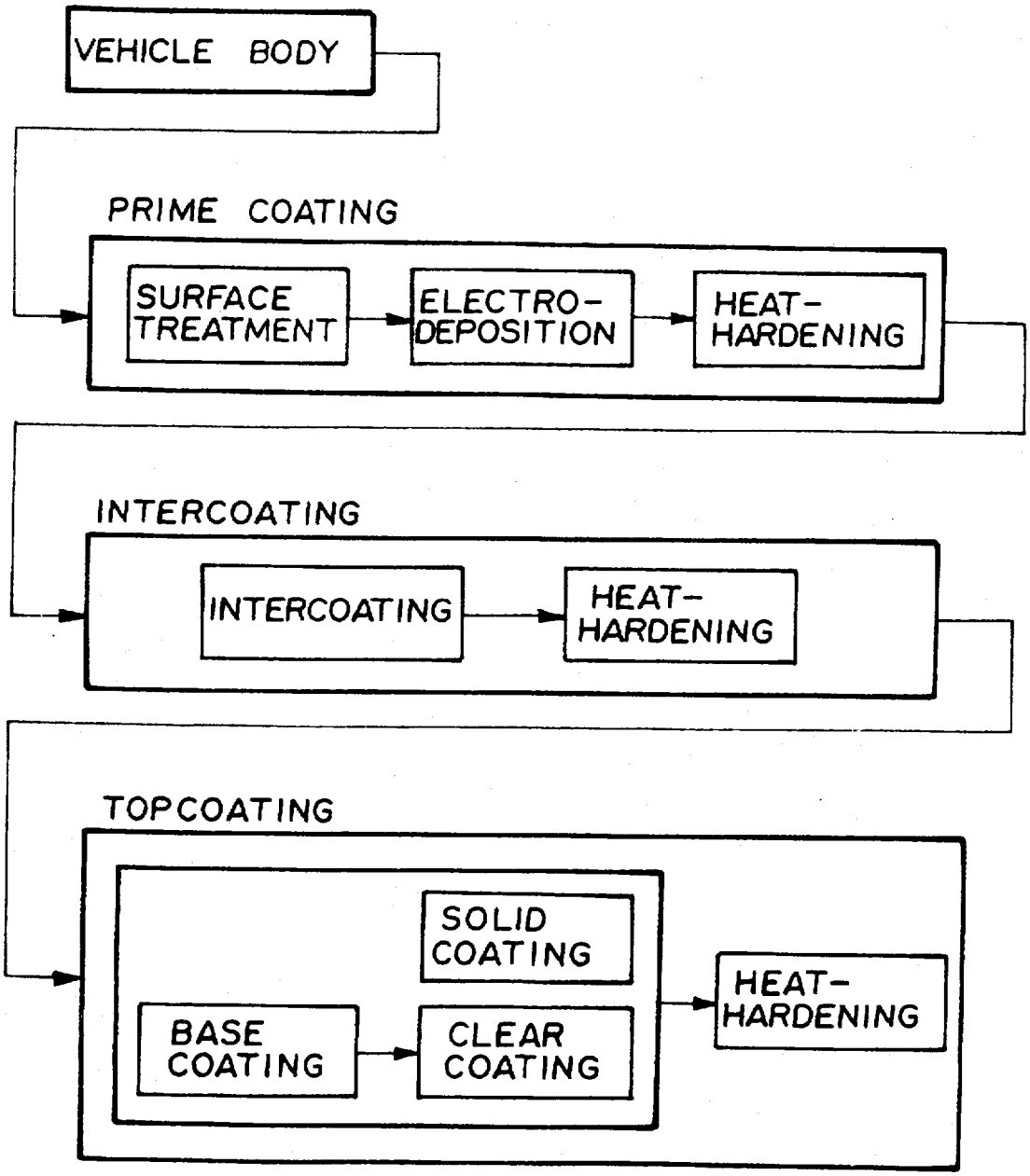
FIG. 1 is a flow chart for briefly illustrating the procedure of coating.

An example of coating of a vehicle body will be described with reference to FIG. 1. As shown in FIG. 1, generally the vehicle body is coated with a prime-coating, an intercoating and a topcoating in this order.

In the prime-coating step, the vehicle body is first subjected to a surface treatment. In the surface treatment, the vehicle body is degreased and then film of zinc phosphate is formed on the vehicle body surface in order to improve bonding strength of coating composition to the vehicle body. Then film of an epoxy coating composition is formed on the film of zinc phosphate by electro-deposition and is hardened by heating.

In the intercoating step, film of a polyester coating composition is formed and hardened by heating.

In the topcoating step, the vehicle body is applied with a solid coating or with a base-clear coating. When the vehicle body is applied with the solid coating, the solid coating film forms the topcoating film. The solid coating composition is first applied to the vehicle body and then hardened by heating. When the vehicle body is applied with the base-clear coating, a base coating composition, for instance, of acrylic resin is first applied to the vehicle body and then a clear coating composition , for instance, of acrylic resin is applied on the base coating composition layer. Thereafter the base coating composition and the clear coating composition are hardened by heating. Combinations of the base coating composition and the clear coating composition include a base coating composition containing therein lustering material such as aluminum or mica and a colorless clear coating composition; a base coating composition containing therein lustering material such as aluminum or mica and a colored clear coating composition; a base coating composition containing therein no lustering material and a colorless clear coating composition; and a base coating composition containing therein no lustering material and a colored clear coating composition. In the base-clear coating, application of the base coating composition and heat-hardening thereof correspond to a base coating step and application of the clear coating composition and heat-hardening thereof correspond to a clear coating step.

The coating the vehicle body described above is only an example, and for example, the intercoating step and/or the clear coating step may be effected twice. Further in the prime-coating step and/or the intercoating step, other various treatments such as sealing treatment, a treatment for improving resistance to chipping and the like may be effected.

Rotational coating

Rotational coating is effected to obtain an excellent smoothness of the coating film surface. The rotational coating can be applied to any coating so long as smoothness of the coating film surface is required. For example, in the case of coating of the vehicle body, the rotational coating can be applied to the intercoating step and the topcoating step. The rotational coating can be suitably applied to the solid coating step and the clear coating step.

Figure 2:
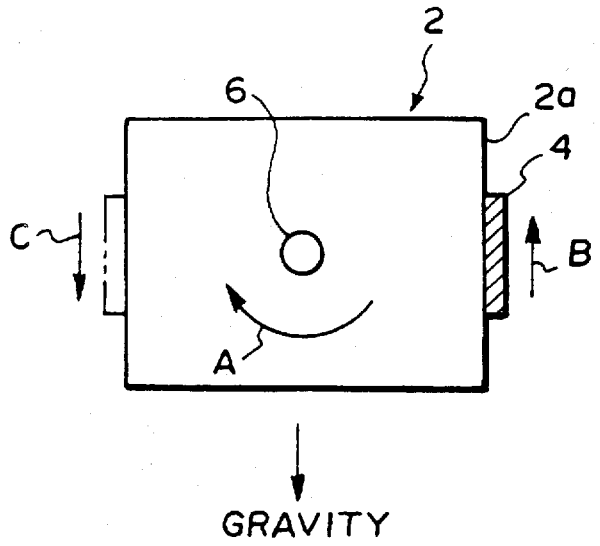
FIG. 2 is a schematic view for illustrating rotation of work to prevent running or sagging of the coating composition.

In the rotational coating, as shown in FIG. 2, a coating composition 4 is applied to a work 2 to a thickness larger than a limit thickness (running limit thickness) over which the coating composition on a surface 2a of the work 2 extending in a vertical direction will normally run or sag and the work 2 is rotated about a substantially horizontal axis 6 after the coating step to prevent the coating composition 4 on the vertical surface 2a of the work 2 from running or sagging.

Figure 3A:
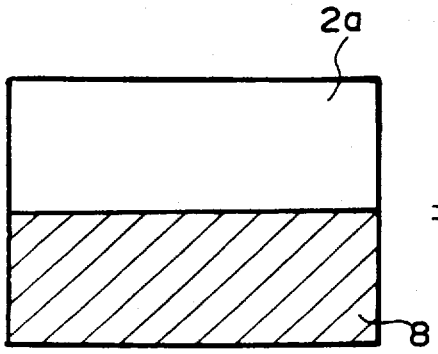
FIGS. 3A and 3B are schematic views for illustrating measurement of running or sagging of the coating composition.
Figure 3B:
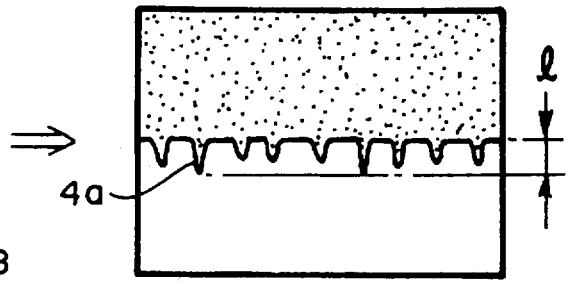

That the coating composition 4 on the vertical surface 2a of the work 2 will normally run or sag means that the coating composition 4 on the vertical surface 2a will run or sag under the gravity if the vertical surface is kept vertical without being rotated. As described before, in this specification, that the coating composition runs or sags means that the coating composition runs or sags 2 mm or more. When the coating composition runs or sags 2 mm or more, unacceptable irregularities are formed on the coating film surface. More particularly, after masking the lower half of the vertical surface 2 by a masking tape as shown in FIG. 3A, the coating composition is applied to the surface 2a and the tape 8 is removed as shown in FIG. 3B. After permitting the work to stand until running or sagging of the coating composition enlarges no more and the length l of the running (or sagging) 4a is measured. When the length l is not shorter than 2 mm, it is determined that running or sagging is occurred. Accordingly, the running limit thickness can be known by repeating measurement of running or sagging in a predetermined setting atmosphere or a predetermined heating atmosphere while gradually increasing the coating thickness and determining the coating thickness at the time the length l becomes not smaller than 2 mm.

The running or sagging of the coating composition is a phenomenon that the coating composition having a flowability runs downward under the gravity. Accordingly, as shown in FIG. 2, when the work 2 is rotated about a substantially horizontal axis 6, a force in the same direction as the gravity and a force opposite to the gravity alternately act on the coating composition, whereby running or sagging of the coating composition is prevented. That is, when the work 2 is continuously rotated in the direction of arrow A in FIG. 2, an inertia force directed toward the direction of arrow B opposite to the gravity acts on the surface 2a when the coating composition 4 on the surface 2a is in the right side as seen in FIG. 2, and an inertia force directed toward the direction of arrow C the same as the gravity acts on the surface 2a when the coating composition 4 on the surface 2a is in the left side. Thus a force in the same direction as the gravity and a force opposite to the gravity alternately act on the coating composition 4 by rotation of the work 2, whereby running or sagging of the coating composition in one direction is prevented. The work 2 need not be continuously rotated in one direction, but may be rotated by a predetermined angle (e.g., 360°, 45°, 90°, 135°) alternately in one direction and the other.

Rotation of the work should be started before the coating composition begins to run or sag under gravity after the coating composition is applied to the work and should be continued until the flowability of the coating composition lowers to such an extent that the coating composition cannot run or sag under gravity. Further the work should be rotated at a rate at which running or sagging of the coating composition can be prevented, e.g., at a rate higher than the rate at which the coating composition runs or sags under gravity, and at which running or sagging of the coating composition under centrifugal force cannot be generated. When the work has a surface to be coated which extends radially from the axis 6, the coating composition on the surface can run or sag under centrifugal force generated by rotation of the work.

Smoothening of the coating film surface by the rotational coating

Figure 4:
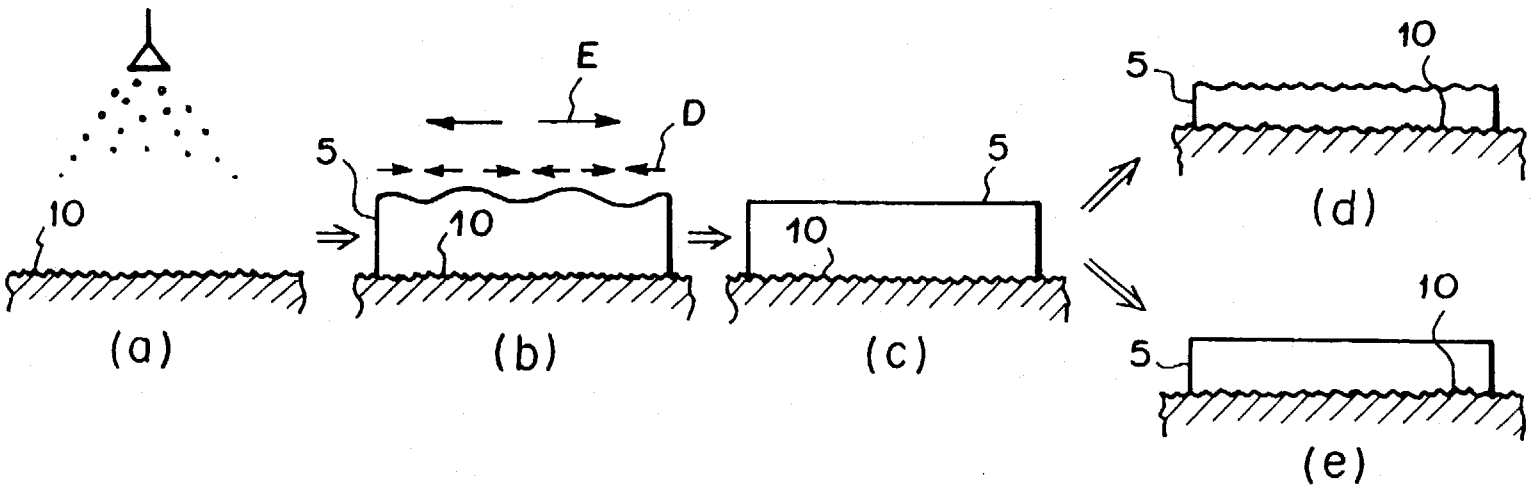
FIG. 4 is a schematic view for illustrating appearance of influence of irregularities on the surface to be coated.

The coating composition is, for instance, sprayed onto a surface 10 to be coated as shown at (a) in FIG. 4. The surface 10 to be coated may be a surface of a work itself or the surface of another coating film which has been applied to the surface. For example, when an intercoating is to be applied to the surface 10, the surface 10 may be the surface of a prime-coating, and when a solid coating is to be applied to the surface 10, the surface 10 may be the surface of an intercoating, and when a clear coating is to be applied to the surface 10, the surface 10 may be the surface of a base coating.

As shown at (b) in FIG. 4, when the coating composition is applied to a certain thickness, the coating film surface 5 is pulled in directions of arrow D parallel to the coating film surface 5 under surface tension and tends to be smooth. When the coating thickness is small, the flowability of the coating composition is poor and a sufficient smoothening effect by the surface tension cannot be obtained. However, when the coating composition is applied to a thickness larger than the running limit thickness, a sufficient smoothening effect by the surface tension can be obtained and the coating film surface 5 can be made excellently smooth.

However when the coating composition is applied to a surface substantially extending in a vertical direction to a thickness larger than the running limit thickness, the coating composition runs or sags on the surface under gravity and smoothness of the coating film surface is greatly deteriorated.

As described above, when the work is rotated about a substantially horizontal axis, a force in the same direction as the gravity and a force opposite to the gravity alternately act on the coating composition, whereby running or sagging of the coating composition is prevented. Further by rotation of the work, forces acting of the coating composition in directions of arrows E parallel to the coating film surface is generated and the smoothening effect by the surface tension is enhanced, whereby more excellent smoothness of the coating film surface can be obtained as shown at (c) in FIG. 4.

That is, when the coating composition is applied to the work to a thickness larger than the running limit thickness and the work is rotated about a horizontal axis, the coating film surface can be made excellently smooth by virtue of the surface tension together with the forces generated by the rotation of the work without fear of the coating composition running or sagging.

Coating plant

A coating plant or apparatus in accordance with an embodiment of the present invention will be described with reference to FIGS. 5 to 13, hereinbelow.

In the coating plant, the vehicle body is coated a clear coating by rotational coating. In this embodiment, a clear thermosetting coating composition containing therein solvent and a setting station including setting zone is provided between coating station including a a coating zone and a heat-hardening station including a heat-hardening zone. The heat-hardening zone includes a pre-heat-hardening zone for half hardening the coating composition and a main heat-hardening for full hardening the coating composition. A temperature holding step is effected early in the pre-heat-hardening step in the pre-heat-hardening zone.

Figure 5:
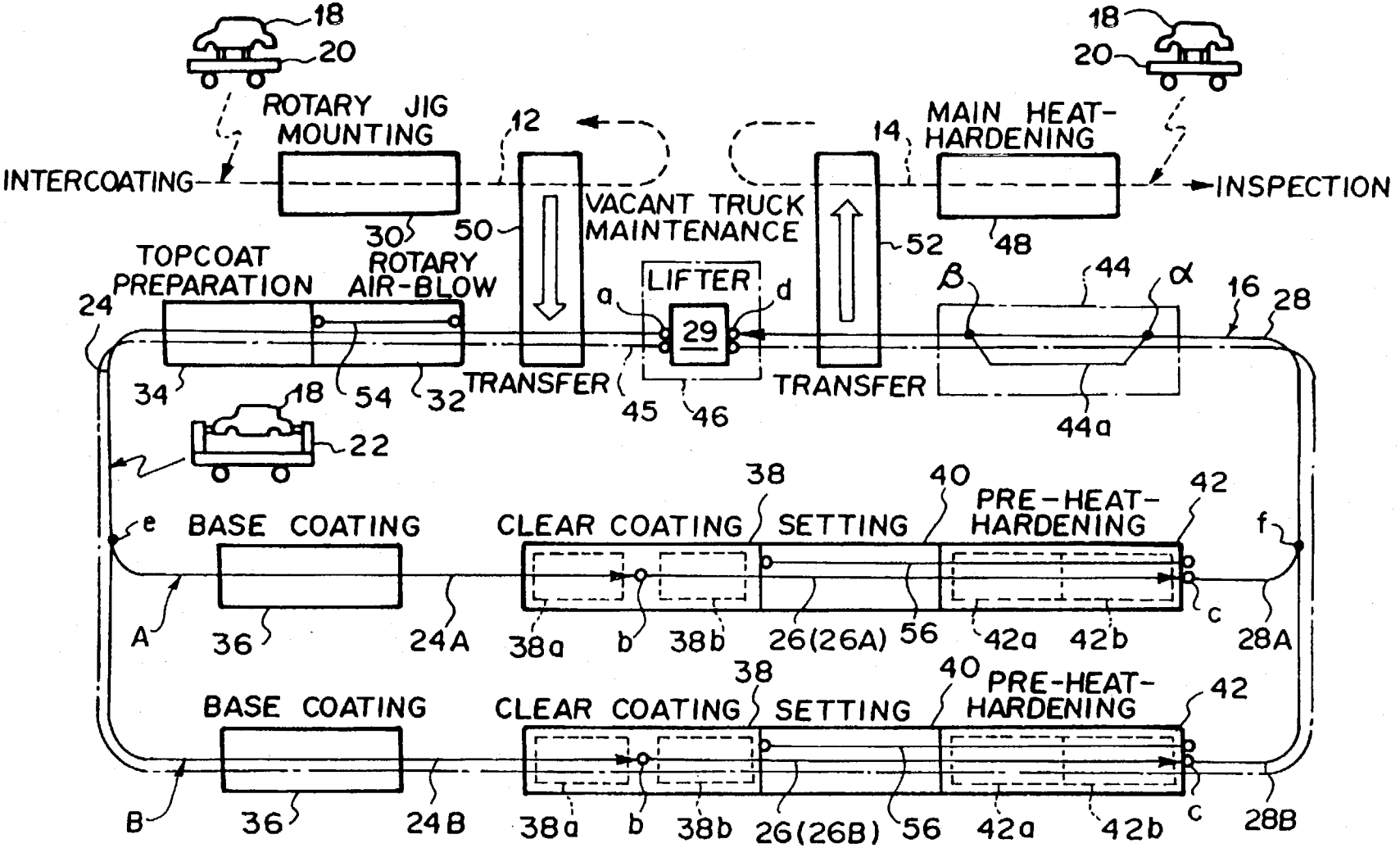
FIG. 5 is a schematic plan view of a plant or an apparatus in accordance with an embodiment of the present invention.
Figure 6:
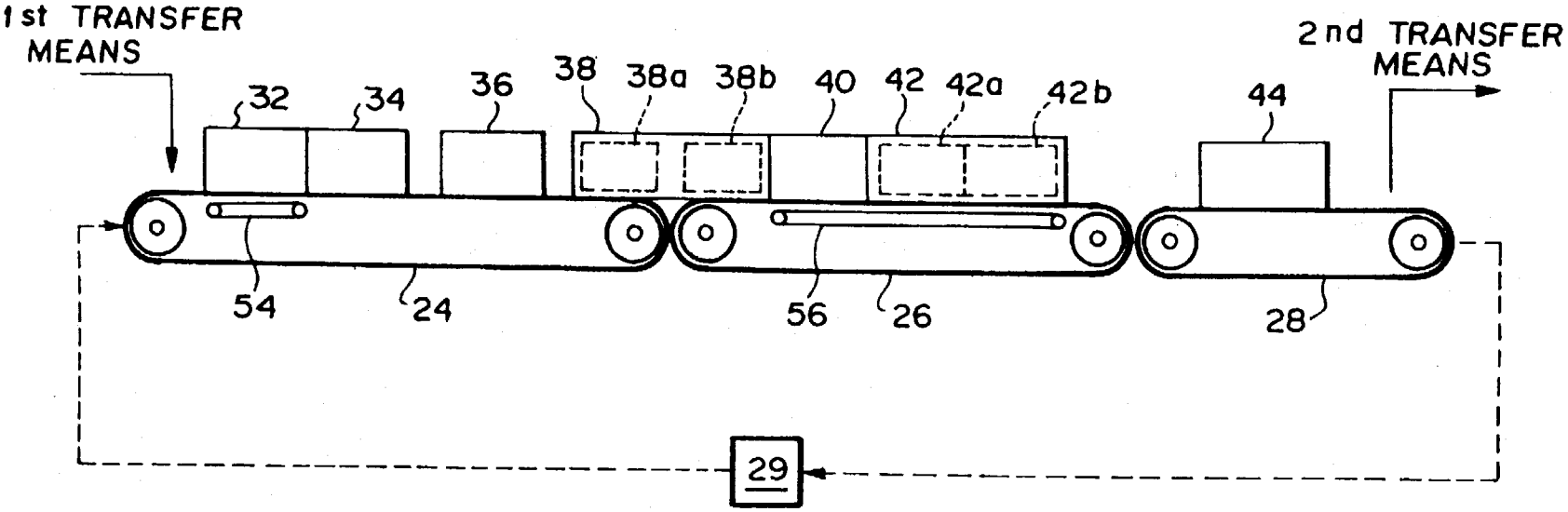
FIG. 6 is a schematic front view of an important part of the plant shown in FIG. 5.

As shown in FIGS. 5 and 6, the coating plant is provided with a first conveyor 12 for non-rotary trucks (will be referred to as "the first non-rotary conveyor 12", hereinbelow), a second conveyor 14 for non-rotary trucks (will be referred to as "the second non-rotary conveyor 14", hereinbelow) and a conveyor 16 for rotary trucks (will be referred to as "the rotary conveyor 16", hereinbelow). The first non-rotary conveyor 12 and the second non-rotary conveyor 14 convey non-rotary trucks 20 which hold stationary vehicle bodies (works) 18 respectively in the directions of arrows, and the rotary conveyor 16 conveys, in the direction an arrow, rotary trucks 22 which holds the vehicle body 18 to be rotatable about an axis extending substantially in a horizontal direction.

The rotary conveyor 16 is arranged in an endless fashion and includes first to third conveyors 24, 26 and 28 which can convey the rotary trucks 22 independently from each other. The second conveyor 26 comprises a pair of conveyors 26A and 26B extending in parallel to each other. The upstream end of the first conveyor 24 is connected to a lifter 29 (to be described later) in a position a, and the downstream end portion of the first conveyor 24 branches into a pair of branch conveyors 24A and 24B at a junction e. The downstream ends of the branch conveyors 24A and 24B are respectively connected to the upstream ends of the conveyors 26A and 26B in positions b. The downstream end of the third conveyor 28 is connected to the lifter 29 in a position d and to the upstream end of the first conveyor 24 through thew lifter 29, and the upstream end portion of the third conveyor 28 branches into a pair of branch conveyors 28A and 28B at a junction f. The upstream ends of the branch conveyors 28A and 28B are respectively connected to the downstream ends of the conveyors 26A and 26B in positions c.

Thus the rotary conveyors 16 has two lines, line A and line B, from the portion corresponding to a base coating zone (to be described later) to the portion corresponding to a pre-heat-hardening zone (to be described later). In the rotary conveyor 16, the conveying speed from the junction f to the junction e can can be made higher than the conveying speed from the junction e to the junction f through the lines A and B.

The first non-rotary conveyor 12 is provided with a rotary jig mounting zone 30. The rotary conveyor 16 is provided with a rotary air-blow zone 32, a topcoating preparation zone 34, a pair of base coating zones 36, a pair of clear coating zones 38 each comprising a first clear coating zone 38*a* and a second clear coating zone 38*b*, a pair of setting zones 40, a pair of pre-heat-hardening zones 42 each comprising a temperature raising zone 42*a* and a half-heat-hardening zone 42*b*, a pooling zone 44 having conveyor 44*a* for pooling and a vacant truck changing station 46 comprising said lifter 29, in this order from the upstream side. The lifter 29 is connected to a vacant truck maintenance station comprising a conveyor 45 for maintenance of vacant trucks. The base coating zones 36, clear coating zones 38, setting zones 40, and the pre-heat-hardening zones 42 are provided each in the lines A and, B. The second non-rotary conveyor 14 is provided with a main heat-hardening zone 48.

The rotary air-blow zone 32, the topcoating preparation zone 34 and the base coating zones 36 are provided on the first conveyor 24. The clear coating zones 38 are provided at the junctions of the branch conveyors 24A and 24B of the first conveyors 24 to the conveyors 26A and 26B. More particularly, the first clear coating zones 38*a* are on the first conveyor 24 (branch conveyors 24A and 24B) and the second or last (i.e., final) clear coating zones 38*b* are on the second conveyor 26 (conveyors 26A and 26B). The setting zones 40 and the pre-heat-hardening zones 42 are provided on the second conveyor 26 (conveyors 26A and 26B) together with the second clear coating zones 38*b*. The pooling zone 44 is provided on the third conveyor 28. The lifter 29 is provided between the downstream end of the third conveyor 28 and the upstream end of the first conveyor 24.

A first transfer means 50 for transferring the vehicle body 18 conveyed by the non-rotary truck 20 on the first non-rotary conveyor 12 to the rotary truck 22 on first conveyor 24 of the rotary conveyor 16 upstream of the air-blow zone 32 is provided between the first non-rotary conveyor 12 and the rotary conveyor 16 (the first conveyor 24). A second transfer means 52 which receives the vehicle body 18 conveyed by the rotary truck 22 on the third conveyor 28 downstream of the pooling zone 44 and upstream of the first transfer means 50 and delivers it to the non-rotary truck 20 on the second non-rotary conveyor 14 is provided between the second non-rotary conveyor 14 and the third conveyor 28.

The rotary air-blow zone 32 is provided with a sub conveyor 54 for rotating the vehicle body 18 on the rotary truck 22 while the rotary truck 22 passes through the rotary air-blow zone 32. The setting zone 40 and the pre-heat-hardening zone 42 on each of the lines A and B are provided with a sub conveyor 56 for rotating the vehicle body 18 on the rotary truck 22 while the rotary truck 22 passes through the setting zone 40 and the pre-heat-hardening zone 42.

Figure 7:
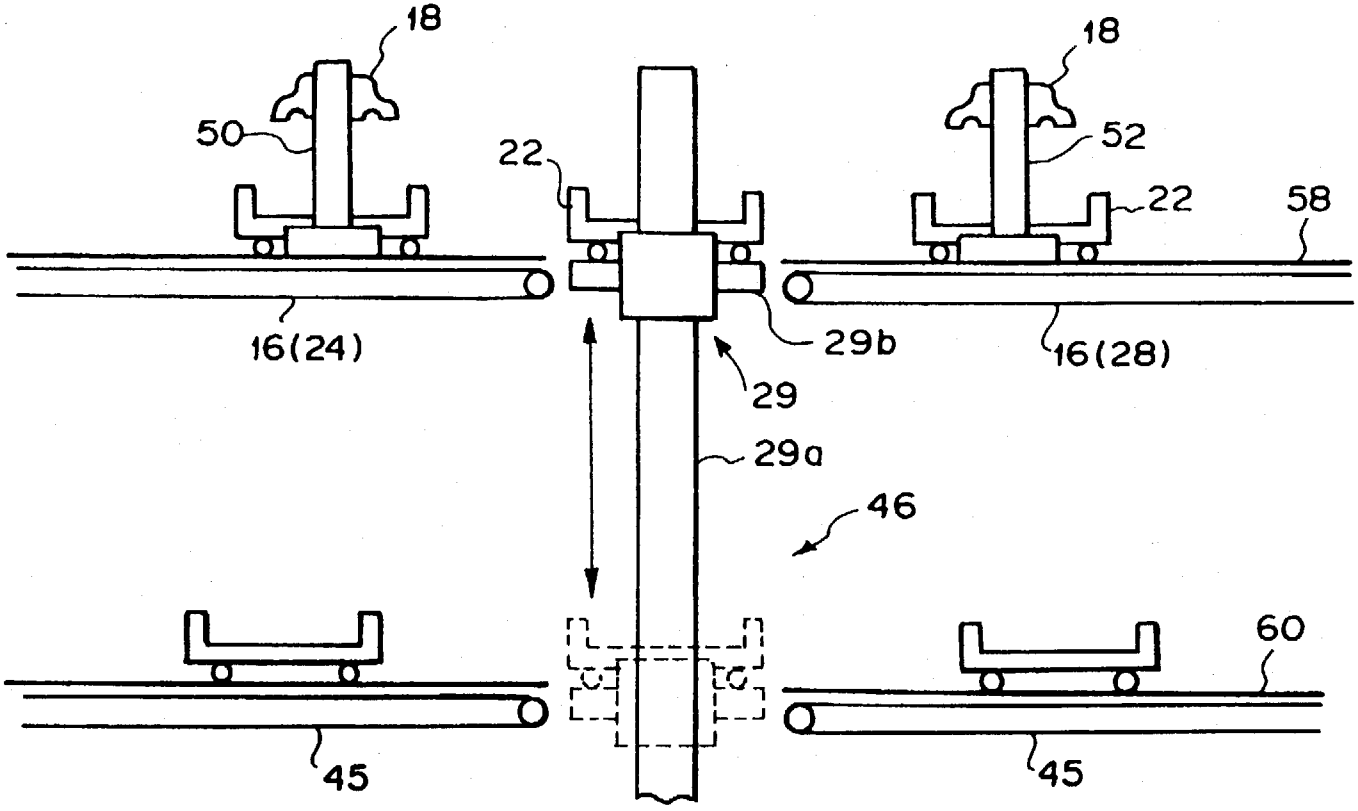
FIG. 7 is a schematic front view showing the vacant truck maintenance station of the plant shown in FIG. 5.

As shown in FIG. 7, the first non-rotary conveyor 12, second non-rotary conveyor 14 and the rotary conveyor 16 are disposed on an upper floor 58 and the conveyor 45 for maintenance of vacant trucks (will be referred to as "the maintenance conveyor 45" hereinbelow) is disposed on a lower floor 60. The lifter 29 comprises a vertical column 29*a* extending from the lower floor 60 to the upper floor 58 and a truck support 29*b* which is moved up and down along the column 29*a* by a driving means not shown. The lifter 29 transfers the vacant rotary truck 22, from which the vehicle body 18 has been removed by the second transfer means 52, to the maintenance conveyor 45 on the lower floor 60. The maintenance conveyor 45 is arranged in an endless fashion with the lifter 29 intervening between the upstream end and the downstream end thereof and extends on the lower floor 58 in the manner similar to the rotary conveyor 16 on the upper floor 60. The vacant rotary truck 22 conveyed by the maintenance conveyor 45 to the downstream end thereof is transferred to the first conveyor 24 on the upper floor 60 by the lifter 29.

Figure 8:
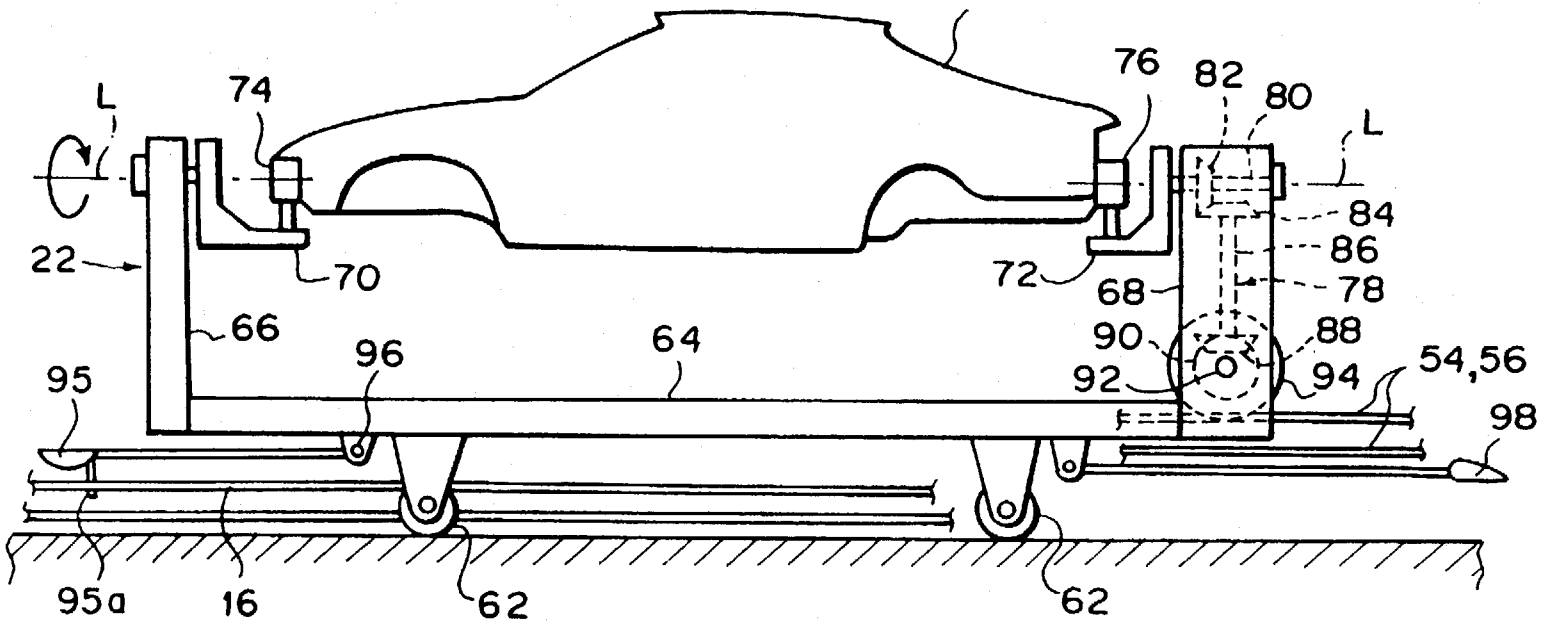
FIG. 8 is a front view of an example of a rotary truck.
Figure 9:
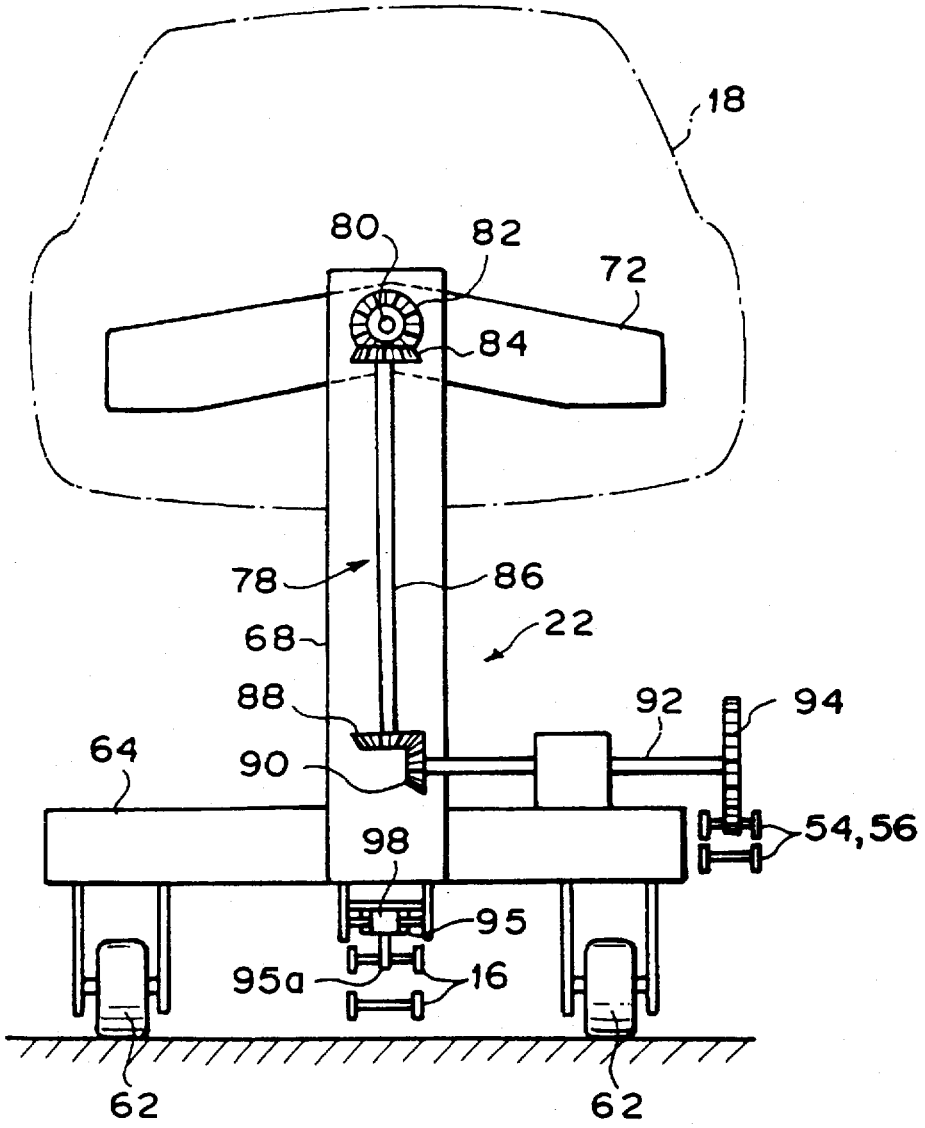
FIG. 9 is a right side view of the rotary truck shown in FIG. 8.

As shown in FIGS. 8 and 9, the rotary truck 22 comprises a base table 64 having wheels 62, a pair of support members 66 and 68 which are fixedly mounted on the base table 64 at a predetermined space in the direction of conveyance to extend vertically, and a pair of rotary supports 70 and 72 which are respectively mounted on the support members 66 and 68 in alignment with each other for rotation about a rotational axis L substantially extending in a horizontal direction.

Rotary jigs 74 and 76 are mounted respectively on the front and rear ends of the vehicle body 18 and the jigs 74 and 76 are connected to the rotary supports 70 and 72, whereby the vehicle body 18 is held between the support members 66 and 68 to be rotatable about the rotational axis L.

A rotation transmitting mechanism 78 for rotating the rear rotary support 72 is provided in the rear support member 68. The rotation transmitting mechanism 78 comprises a bevel gear 82 fixed to a rotational shaft 80 of the rotary support 72, a bevel gear 84 which is fixed to one end of a shaft 86 and is in mesh with the bevel gear 82, a bevel gear 88 fixed to the other end of the shaft 86, a bevel gear 90 which is fixed to one end of a shaft 92 and is in mesh with the bevel gear 88 and a sprocket 94 fixed to the other end of the shaft 92.

The sprocket 94 is adapted to be engaged with said sub conveyors 54 and 56 which comprises chains. In this rotation transmitting mechanism 78, when a difference is generated between the conveying speed of the rotary truck 22 and the driving speed of the sub conveyors 54 and 56, the sprocket 94 is rotated and the rotation of the sprocket 94 is transmitted to the rear rotary support 72 through the rotation transmitting mechanism 78, whereby the vehicle body 18 is rotated about the rotational axis L. By adjusting the driving speed of the sub conveyors 54 and 56, the rotational speed and/or rotational direction of the vehicle body 18 can be changed and at the same time the vehicle body 18 can be rotated even while the rotary truck 22 is stopping.

An engagement piece 95 which extends forward and is provided with a downward projection 95*a* is mounted on the front side of the base table 64 to be rotatable about about a pin 96. By way of an engagement between the projection 95*a* and the rotary conveyor 16 which is of chains, the rotary truck 22 is conveyed at the driving speed of the rotary conveyor 16. An engagement release piece 98 is mounted on the rear side of the base table 64 to extend rearward at a predetermined level held by a holding member (not shown). When a succeeding rotary truck 22 approaches a rotary truck 22 and the engagement piece 95 of the succeeding rotary truck 22 rides on the engagement release piece 98 of the forward rotary truck 22, the engagement piece 95 of the succeeding rotary truck 22 is rotated upward and the engagement between the projection 95*a* and the rotary conveyor 16 is released, whereby the succeeding rotary truck 22 can be stopped short of the forward rotary truck 22 even if the rotary conveyor 16 is operating with the forward rotary truck 22 stopped.

In the pre-heat-hardening zone 42, a preheating oven 100 (FIGS. 10 and 11) extends over the entire length of the zone 42. Pre-heat-hardening of the base coating and the clear coating on the vehicle body 18 is effected by passing the vehicle body 18 through the preheating oven 100

Figure 10:
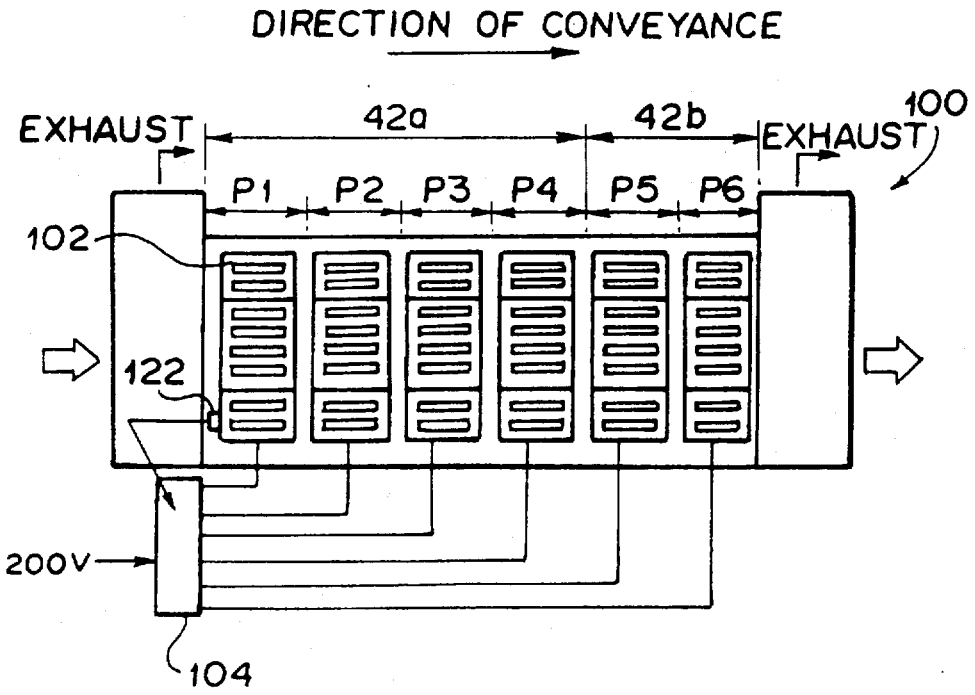
FIG. 10 is a front view of the preheating oven.
Figure 11:
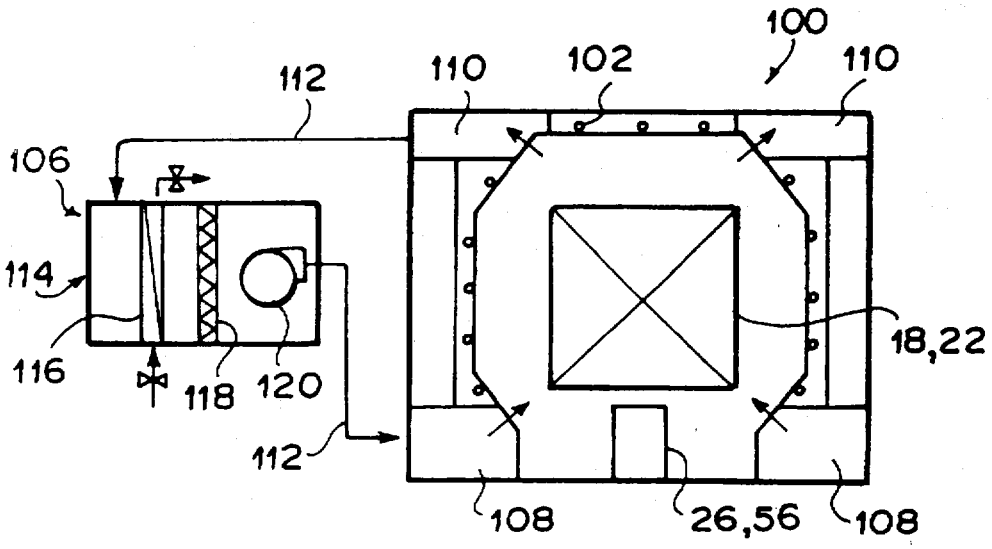
FIG. 11 is a right side view of the preheating oven shown in FIG. 10.

As shown in FIGS. 10 and 11, the preheating oven 100 comprises a tunnel-like far-infrared oven and each of the conveyors 26A and 26B and each of the sub conveyors 56 extends through the oven. The preheating oven 100 is in the form of a divided heating oven in which a plurality of (six in this particular embodiment) heating zones P1 to P6 are arranged in a row in the direction of conveyance of the vehicle body 18 and each of the heating zones P1 to P6 is provided with a plurality of far-infrared irradiating means 102 as a heat source. As shown in FIG. 11, the far-infrared irradiating means 102 in each heating zone are arranged in U-shape at predetermined intervals on the inner surface of the oven. The supply voltages for the heating zones can be controlled independently from each other by a controller 104. In order to prevent solvent evaporating from the coating composition from filling the preheating oven 100, a ventilator 106 is provided in the oven 100. The ventilator 106 comprises an air supply box 108 disposed on the lower side of the oven 100, an exhaust box 110 disposed on the upper side of the oven 100, and a pumping means 114 provided in an air passage 112 between the air supply box 108 and the exhaust box 110. The pumping means 114 comprises a heat exchanger 116 whose heat source is steam, a filter 118 and an air supply fan 120. Hot air heated to a predetermined temperature by the heat exchanger 116 is introduced into the oven 100 through the air supply box 108 and moves upward in the oven 100 to be exhausted through the exhaust box 110. The air exhausted through the exhaust box 110 is partly released to the atmosphere and is partly returned to the heat exchanger 106 by the pumping means 114. The exhausted through the exhaust box 110 and returned to the heat exchanger 106 is heated to the predetermined temperature together with fresh air and introduced into the oven 100 again through the air supply box 108. A temperature sensor 122 is provided for each of the heating zones P1 to P6 (only the sensor 122 for the heating zone P1 is shown in FIG. 10) and the controller 104 feedback-controls the far-infrared irradiating means 102 in each heating zone on the basis of the output of the temperature sensor 122.

The upstream side four heating zones P1 to P4 form the temperature raising zone 42*a* and the other two heating zones P5 and P6 form the half-heat-hardening zone 42*b*.

A main heating oven 124 extends over the entire length of the main heat-hardening zone 48, and the base coating film and the clear coating film on the vehicle body 18 are full hardened by passing through the main heating oven 124.

Figure 12:
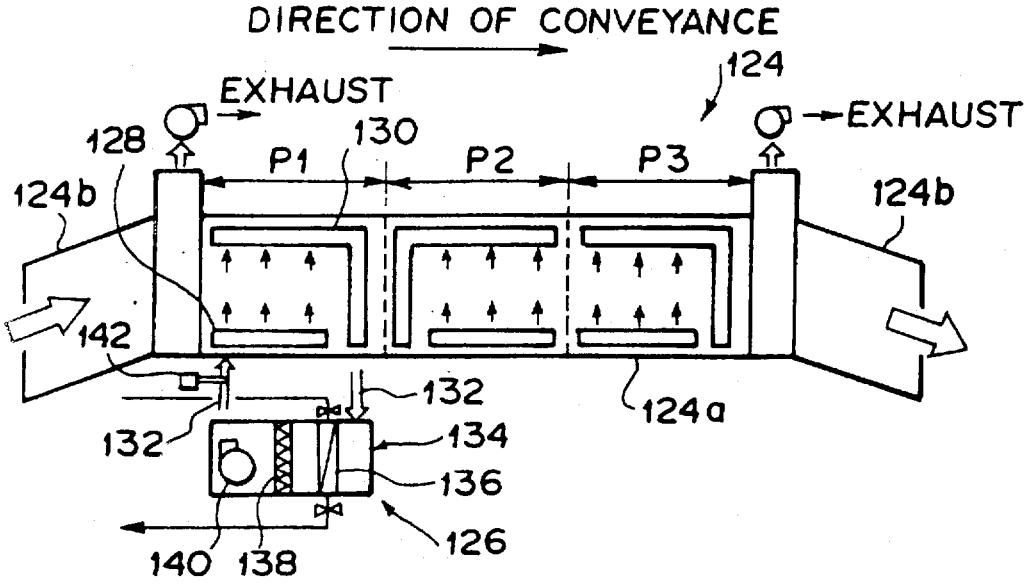
FIG. 12 is a front view of the main heating oven.
Figure 13:
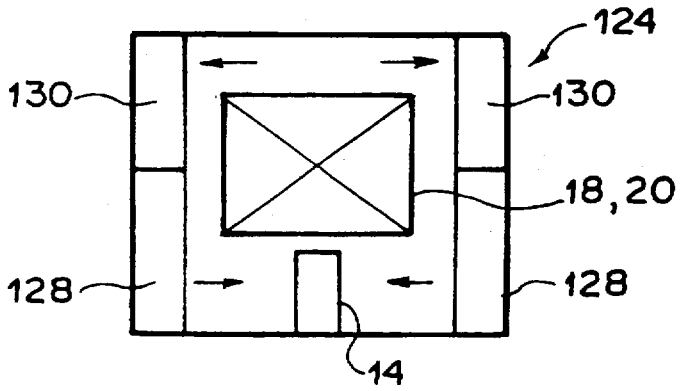
FIG. 13 is a right side view of the main heating oven shown in FIG. 12.

As shown in FIGS. 12 and 13, the main heating oven 124 is in the form of an angular oven which extends in the direction of conveyance in a tunnel-like fashion. The oven 124 comprises a base portion 124*a* at which the coating films on the vehicle body 18 are actually heated and a pair of inclined portions 124*b* provided on opposite sides of the base portion 124*a* to raise the base portion 124*a* to an elevated position. In the oven 124, hot air is used as the heat source. The second non-rotary conveyor 14 extends through the main heating oven 124 and the vehicle body 18 on the non-rotary truck 20 is passed through the oven 124. In this oven 124, the base portion 124*b* comprises a plurality of (three in this particular embodiment) heating zones P1 to P3 arranged in a row in the direction of conveyance of the vehicle body 18. Each of the heating zones P1 to P3 is provided with a hot air supply means 126, and the temperature and the flow rate of the hot air discharged from the hot air supply means 126 in the heating zones P1 to P3 can be controlled independently. The hot air supply means 126 comprises an air supply box 128 disposed on the lower side of the oven 124, an exhaust box 130 disposed on the upper side of the oven 124, and a pumping means 134 provided in an air passage 132 between the air supply box 102 and the exhaust box 130. (The air passage 132 and the pumping means 134 are only shown for the heating zone P1) The pumping means 134 comprises a heat exchanger 136 whose heat source is steam, a filter 138 and an air supply fan 140.

Hot air heated to a predetermined temperature by the heat exchanger 136 is introduced into the oven 124 through the air supply box 128 and moves upward in the oven 124 to be exhausted through the exhaust box 130. The air exhausted through the exhaust box 130 is returned to the heat exchanger 106 by the pumping means 134 and is recirculated. A temperature sensor 142 for detecting the temperature of the hot air introduced into each heating zone is provided for each of the heating zones P1 to P3, and the temperature of the hot air in each heating zone is feedback-controlled on the basis of the output of the temperature sensor 142.

Method of coating

How to coat the vehicle body 18 by the plant described above will be described, hereinbelow. A vehicle body 18 finished with the intercoating is conveyed on the non-rotary truck 20 by the first non-rotary conveyor 12 in the direction of the arrow (FIG. 5) and the rotary jigs 74 and 76 are mounted on the front and rear sides of the vehicle body 18 in the rotary jig mounting zone 30. Thereafter the vehicle body 18 is transferred to the rotary truck 22 on the rotary conveyor 16 from the non-rotary truck 20 by the first transfer means 50.

The vehicle body 18 is then conveyed on the rotary truck 22 through the rotary air-blow zone 32, and while passing through the rotary air-blow zone 32, the vehicle body 18 is rotated by the sub conveyor 54 and air is blow on the vehicle body 18, whereby dirt, dust and the like on or in the vehicle body 18 are removed. Then the vehicle body 18 is conveyed to the topcoating preparation zone 34 and the vehicle body 18 is swept with ostrich feather to completely remove dirt, dust and the like on the vehicle body 18. Thereafter, the vehicle body 18 is alternately introduced into the line A or B and conveyed to the base coating zone 36 where the base coating composition (for the topcoating) is applied to the vehicle body 18. In this embodiment, the base coating composition comprise acryl-melamine resin containing therein lustering material such as aluminum or mica and pigments and the like and is applied on the intercoating film. The base coating composition is, for instance, once applied to the outer surface of the vehicle body 18, and then applied to the door openings, the inner side of the doors and the like, and then applied to the outer surface of the vehicle body 18 twice. Generally the base coating composition contains a solvent which is low in boiling point and is ready to evaporate and is applied in a relatively small thickness (e.g., 20μ). Accordingly the coating composition cannot run or sag.

Thereafter the vehicle body 18 is conveyed to the clear coating zone 38, and the clear coating composition is applied on the base coating film by a suitable coating means such as a coating robot. A predetermined idle zone is provided between the base coating zone 36 and the clear coating zone 38 and the solvent in the base coating composition is sufficiently evaporated while the vehicle body 18 is passed through the idle zone.

The clear coating composition to be applied on the base coating film comprises, in this particular embodiment, a clear resin coating composition of acryl-melamine resin containing a volatile solvent. The clear coating composition is applied twice in the clear coating zone 38. That is, in the first clear coating zone **38*a* provided on the downstream end portion of the first conveyor 24, the clear coating composition is first applied to a thickness smaller than the running limit thickness in the setting zone 40, and then the rotary truck 22 carrying the vehicle body 18 is transferred to the second conveyor 26 in the position b. Then the vehicle body 18 is conveyed to the second or last (i.e., final) clear coating zone 38*b* provided on the upstream end portion of the second conveyor 26 and the clear coating composition is applied on the clear coating film applied in the first clear coating zone 38*a* so that the total thickness of the clear coating film becomes larger than the running limit thickness in the setting zone 40**.

After the clear coating, the vehicle body 18 is conveyed to the setting zone 40 and the volatile solvent in the clear coating composition is caused to evaporate at an ordinary temperature while the vehicle body 18 is passed through the setting zone 40. While the vehicle body 18 is passed through the setting zone 40, the vehicle body 18 is rotated by the sub conveyor 56 to prevent running or sagging of the coating composition.

While the vehicle body 18 is passed through the setting zone 40, the volatile solvent in the coating composition gradually reduces and the flowability of the coating composition gradually lowers. The coating composition has sometimes lost its flowability by the end of the setting. The setting conditions, i.e., the setting temperature and the setting time may be suitably set according to the kind of the clear coating composition (e.g., kind of the resin and the solvent, and the amounts thereof), the thickness of the coating film, the pre-heat-hardening conditions and the like.

After the setting, the vehicle body 18 is conveyed to the pre-heat-hardening zone 42, and the clear coating film is pre-heat-hardened while the vehicle body 18 is passed through the preheating oven in the pre-heat-hardening zone 42. In the temperature raising zone **42*a* of the pre-heat-hardening zone 42, a temperature-raising step of raising the temperature of the clear coating composition to its reaction starting temperature, and in the course of heating the coating composition to the reaction starting temperature, a temperature holding step of holding the temperature of the coating composition at a predetermined temperature lower than the reaction starting temperature and higher than the ordinary temperatures for a predetermined time is effected, whereby a sufficient amount of the solvent is evaporated while keeping the flowability of the clear coating composition. Then in the half-heat-hardening zone 42*b*, the temperature of the coating composition is held not lower than the reaction starting temperature, whereby the coating composition is partly hardened (pre-heat-hardening). The pre-heat-hardening is for hardening the coating composition to such an extent that even if dust or the like is subsequently deposited on the surface of the clear coating film, the dust can be readily burnt off by subsequent heating. For example, the coating composition is caused to make crosslinking reaction up to about 40%. Also the base coating film is subjected to the temperature holding in the temperature raising zone 42*a* and is partly hardened in the half-heat-hardening zone 42*b***.

Though the flowability of the clear coating composition is very low or null at the end of the setting, the solid component or the resin component is softened (reduced in viscosity) in the course of the temperature of the coating composition being raised to the reaction starting temperature in the temperature raising zone **42*a* and the flowability of the coating composition rapidly increases to a state where running or sagging can take place. The flowability lowers as the solvent subsequently evaporates and the flowability is rapidly lost at the time the temperature of the coating composition reaches the reaction starting temperature and the coating composition begins reaction in the half-heat-hardening zone 42*b***.

The predetermined temperature and the predetermined time in the temperature holding step may be suitably set according to the kind of the clear coating composition (e.g., kind of the resin and the solvent, and the amounts thereof), the thickness of the coating film, the setting conditions and the like so that the amount of the solvent can be sufficiently reduced while keeping a flowability of the coating composition. The predetermined temperature may be changed according to the predetermined time and the predetermined time may be changed according to the predetermined temperature. Preferably the predetermined temperature is in the range from a temperature higher than the ordinary temperatures by at least 20° C. (generally 40° C.) to a temperature lower than the reaction starting temperature by at least 10° C. Preferably the predetermined time is set so that the coating composition can be held in such a state for at least one minute that amount of the solvent i sufficiently small and the coating composition has a flowability. Also the half-heat-hardening conditions in the half-heat-hardening zone **42*b***, i.e., the temperature and the time, may be suitably set according to the kind of the clear coating composition (e.g., kind of the resin and the solvent, and the amounts thereof), the thickness of the coating film, the setting conditions, the temperature holding conditions and the like.

Figure 14:
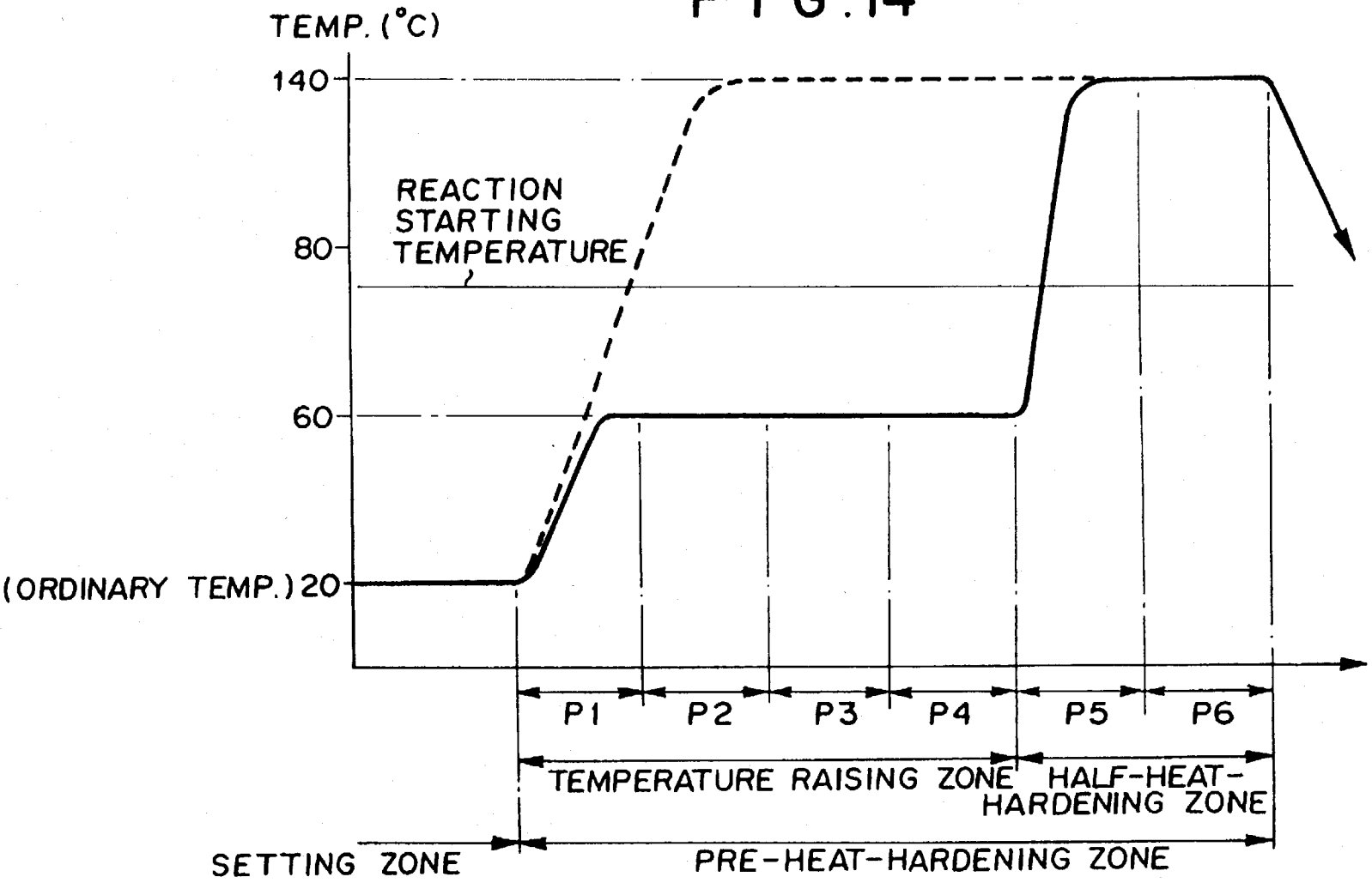
FIG. 14 is a view showing the change in the temperature of the coating composition in the pre-heat-hardening step which includes the temperature holding step.

FIG. 14 shows an example of change in temperature of the clear coating composition in the pre-heat-hardening zone 42.

As shown in FIG. 14, in the setting zone 40, the coating composition is held at an ordinary temperature (20° C. in this embodiment), and when the vehicle body 18 is conveyed into the pre-heat-hardening zone 42, the temperature of the coating composition is raised to its reaction starting temperature (70° C. to 80° C. in this embodiment) and is held at a predetermined temperature (60° C. in this embodiment) lower than the reaction starting temperature and higher than the ordinary temperatures for a predetermined time in the course of raising the temperature to the reaction starting temperature in the temperature raising zone 42*a* (heating zones P1 to P4). The predetermined temperature need not be constant but may change in a predetermined temperature range. For example, the predetermined temperature may be gradually increased. Then in the half-heat-hardening zone 42*b* (heating zones P5 and P6), the temperature of the coating composition is raised to a predetermined temperature (140° C. in this embodiment) not lower than the reaction starting temperature, and the coating composition is caused to half harden at the predetermined temperature.

The predetermined time in the temperature holding step can be changed by changing the temperature (atmospheric temperature) in the heating zones P1 to P4 and the predetermined time can be changed by changing the number of the heating zones actually used. For example, the number of the vehicle bodies 18 to be coated a day is changed, the conveying speed of the rotary conveyor 16 is changed whereby the the conveying speed of the vehicle body 18 through the preheating oven is changed. In such a case, when the same number of heating zones are used, the predetermined time in the temperature holding step changes, and accordingly the number of the heating zones actually used for the temperature holding step is changed. For example, when the conveying speed is lowered, only the heating zones P1 to P3 are used for the purpose of temperature holding with the heating zones P4 and P5 used as the half-heat-hardening zone and with the heating zone P6 nut used, whereby said predetermined time can be readily held unchanged.

Also the temperature of the coating composition and the heating time in the half-heat-hardening zone 42*b* can be readily changed by the number of the heating zones actually used and the atmospheric temperature therein.

In the embodiment described above, the atmospheric temperatures in the respective heating zones P1 to P4 are the same, and accordingly when the heat capacity of the work is large and it takes along to raise the temperature of the coating composition to the predetermined temperature, the temperature raising zone 42*a* must be longer. In such a case, by increasing the temperature in the heating zone P1 higher than those in the other heating zones so that the temperature of the coating composition rises to the predetermined temperature in a shorter time, the preheating oven may be small in length. That is, by separately controlling the temperature in the respective heating zones, the temperature raising pattern can be variously changed for various purposes.

In the pre-heat-hardening zone 42, especially in the temperature raising zone 42*a*, the solid component of the coating composition is softened and the flowability of the coating composition becomes very high, whereby the coating composition comes into "the running state". Accordingly, in the pre-heat-hardening zone 42, the vehicle body 18 is kept rotated following in the setting zone 40 by the sub conveyor 56 to prevent running or sagging of the coating composition. Since the rotation of the vehicle body 18 is for preventing running and sagging of the coating composition, the vehicle body 18 need not be rotated in the heating zone P6 if the coating composition comes into "the non-running state" in the heating zone P5 as shown in FIG. 14.

Further, though, in the embodiment described above, the temperature holding step is effected in the temperature raising zone 42*a*, the temperature of the coating composition may be directly raised above the reaction starting temperature without effecting the temperature holding step. In this case, the temperature of the coating composition is linearly raised above the reaction starting temperature as shown by the broken line in FIG. 14.

After the pre-heat-hardening in the pre-heat-hardening zone 42, the rotary truck 22 carrying the vehicle body 18 is transferred to the third conveyor 18 in the position c, and conveyed to the pooling zone 44 with the vehicle bodies 18 on the lines A and B merging together at the junction f. The vehicle body 18 is pooled in the pooling zone 44 as required, and then is transferred to the non-rotary truck 20 on the second non-rotary conveyor 14 by the second transfer means 52. Thereafter the vehicle body 18 on the non-rotary truck 20 is conveyed into the main heat-hardening zone 48 by the second non-rotary conveyor 14. While the vehicle body 18 is passed through the main heat-hardening zone 48, the base coating film and the clear coating film are held at a predetermined temperature not lower than the reaction starting temperature for a predetermined time, whereby the coating films are hardened to a final degree, which may be such as obtained by about 80% crosslinking reaction of the coating composition.

After the main heat-hardening step, the vehicle body 18 is conveyed to an inspection zone (not shown) to be checked with the coating.

Separation of the pre-heat-hardening and the main heat-hardening

In this embodiment, the heating oven for the heat-hardening step is divided into the preheating oven and main heating oven which are disposed in different positions. When the preheating and the main heating are effected in separate ovens as in this embodiment, the following advantages are obtained.

That is, as the heating oven, a hot-air type oven is simple in structure and low in the heat source cost, but when both the pre-heat-hardening and the main heat-hardening are effected in one hot-air type oven, there is involved the following problem. That is, since the coating composition is in the running state in the front portion of the oven, that is, the portion of the oven for pre-heat-hardening, the vehicle body 18 must be rotated and when the vehicle body 18 is rotated, dirt and dust in the vehicle body 18 get out of the vehicle body 18 and adheres to the coating film surface which is not hardened yet. Though such a problem can be avoided by use of, for instance, a far-infrared oven, the far-infrared oven is very expensive. Thus when a far-infrared oven is used for the pre-heat-hardening and a hot-air type oven is used from the main heat-hardening, the oven for the heat-hardening can be manufactured at relatively low cost.

Further when both the pre-heat-hardening and the main heat-hardening are effected in one hot-air type oven, the oven must be provided on the rotary conveyor 16 since the vehicle body 18 must be rotated in the portion of the oven for pre-heat-hardening, which results in a longer rotary coating line. Accordingly by separating the oven for the pre-heat-hardening from the oven for the main heat-hardening and providing only the oven for the pre-heat-hardening on the rotary conveyor 16 while providing the oven for main heat-hardening on the second non-rotary conveyor 14, the rotary coating line can be short.

Further when both the pre-heat-hardening and the main heat-hardening are effected in one hot-air type oven, it is preferred that the oven is an angular oven from the view point of the thermal efficiency. That is, in the angular oven, heat is accumulated in the base portion which is in an elevated position and heat is less apt to be dissipated from the ends of the oven than in a flat oven. However, in the oven, the vehicle body 18 must be rotated and the vehicle body 18 must be conveyed through the oven on the rotary truck 22 which is longer than the non-rotary truck 20. Accordingly, when the oven is of an angular type, the inclined portions on opposite ends of the base portion for raising the base portion to an elevated position must be long so that they merge to the flat portion at a small angle (otherwise the rotary truck which is longer than the non-rotary truck can be disengaged from the conveyor), which results in a larger length of the oven and a larger length of the rotary coating line. Accordingly by separating the oven for the pre-heat-hardening from the oven for the main heat-hardening and providing only the oven for the pre-heat-hardening (which may be a flat far-infrared oven and in which the vehicle body 18 must be rotated) on the rotary conveyor 16 while providing the oven for main heat-hardening (which is preferably a hot-air type angular oven and in which the vehicle body 18 need not be rotated) on the second non-rotary conveyor 14, the rotary coating line can be short and the cost for the ovens can be lowered.

Though, in the embodiment described above, the preheating oven is of a far-infrared type and the main heating oven is of a hot air type, other various types of ovens can be used. Further, though, in the embodiment described above, a flat oven is used as the preheating oven and an angular oven is used as the main heating oven, they need not be limited so. Further, though, in the embodiment described above, the main heat-hardening zone 48 is provided on the second non-rotary conveyor 14, it may be provided on the rotary conveyor 16.

Though, in the embodiment described above, the temperature raising step and the half-heat-hardening step are effected in a preheating oven, those steps may be effected in separate ovens. In this case, the vehicle body 18 may be rotated only in the oven for the temperature raising step since running or sagging of the coating composition basically occurs in the temperature raising step and does not occur in the half-heat-hardening step.

Vacant truck changing station

The vacant truck changing station 46 will be described, hereinbelow. The vacant rotary truck 22 from which the vehicle body 18 has been transferred to the non-rotary truck 20 on the second non-rotary conveyor 14 is conveyed to the lifter 29 (which forms the vacant truck changing station 46) and is transferred to the maintenance conveyor 45 (which forms the vacant truck maintenance station) on the lower floor by the lifter 29. Then the rotary truck 22 is subjected to maintenance such as cleaning, upkeep, check and the like while it is conveyed to the downstream end of the maintenance conveyor 45 and then transferred again to the rotary conveyor 16 by the lifter 29.

The rotary conveyor 16 is subjected to maintenance at regular intervals. During maintenance, all the rotary trucks 22 on the rotary conveyor 16 are transferred to the maintenance conveyor 45 on the lower floor. Accordingly, the maintenance conveyor 45 should have a length sufficient to accommodate all the rotary trucks 22 on the rotary conveyor 16. Simultaneously with maintenance of the rotary conveyor 16, maintenance of the rotary truck 22 can be effected.

By thus providing the vacant truck changing station 46 (the lifter 29) between the second transfer means 52 and the first transfer means 52 and connecting the lifter 29 to the maintenance conveyor 45 (the vacant truck maintenance station), the rotary truck 22 is subjected to the maintenance every time it runs over the rotary conveyor, and then reused. Accordingly, the problem of defect in coating due to dust or the like on the rotary truck and/or trouble in the mechanism for rotating the work can be avoided and an extremely smooth coating film surface can be constantly obtained.

Pooling zone

Said pooling zone 44 will be described, hereinbelow. As described above, the pooling zone 44 is provided on the third conveyor 28 between the pre-heat-hardening zone 42 and the second transfer means 52. The pooling zone 44 is for temporarily staying a predetermined number of rotary trucks 22 carrying the vehicle bodies 18 which has finished with the pre-heat-hardening.

In coating plant of this embodiment, the conveyor line is separated between the first clear coating zone **38*a* where the coating composition is applied to a thickness smaller than the running limit thickness and the second clear coating zone 38*b* where the coating composition is applied to a thickness larger than the running limit thickness, and the first conveyor 24 on the side of the first clear coating zone 38*a* and the second conveyor 26 on the side of the second clear coating zone 38*b*** are arranged to be driven separately from each other.

This arrangements permits the second conveyor 26 to continuously convey the vehicle body 18 which has been applied with the coating composition in a thickness larger than the running limit thickness into the rotating zone where the vehicle body 18 is rotated, i.e., the setting zone 40 and/or the pre-heat-hardening zone 42 or through the rotating zone so that the vehicle body 18 is rotated to prevent running or sagging of the coating composition or the coating composition is half hardened even if some trouble occurs in the first clear coating zone **38*a*** or the coating line upstream thereof.

However, some trouble can occur also in the downstream side of the second coating zone. In this case, it can be possible to convey the vehicle body 18 which has been applied to a thickness larger than the running limit thickness out the second clear coating zone **38*b* into the rotating zone where the work is rotated and running or sagging of the coating composition is prevented (e.g., the setting zone 40 and/or the pre-heat-hardening zone 42) or through the pre-heat-hardening zone 42, thereby preventing the coating composition from running or sagging, so long as the trouble occurs in a part downstream of the rotating zones and the position where the coating composition has come into such a state that running or sagging cannot occur (e.g., in the second transfer means 52, the main heat-hardening zone 48, or the inspection zone or the assembly zone downstream of the main heat-hardening zone 48) and the rotary conveyor 16 itself can convey the vehicle body 18 downstream from the second clear coating zone 38*b***.

However when the rotary conveyor 16 downstream of the second clear coating zone **38*b* is filled with the vehicle bodies 18, the vehicle body 18 in the second clear coating zone 38*b* cannot be conveyed out the second clear coating zone 38*b*** and must stay there, which results in running of sagging of the coating composition and defect in coating.

The pooling zone 44 is for the purpose of avoiding the problem. That is, even if some trouble occurs in the second transfer means 52, the main heat-hardening zone 48, the inspecting zone and the subsequent assembly line, the vehicle body 18 can be conveyed out of the second clear coating zone **38*b* into the rotating zone and rotated to prevent running or sagging of the coating composition as well as to pre-heat-harden the coating film thereon to avoid a problem of adhesion of dust or the like to the coating film by moving the rotary trucks 22 on the rotary conveyor 16 downstream of the second clear coating zone 38***b* to the pooling zone 44.

In this embodiment, the pooling zone 44 is formed by connecting a sideline conveyor 44*a* to the third conveyor 28 at junctions α and β so that the rotary trucks 22 can be temporarily stayed on the sideline conveyor 44*a*. The pooling zone 44 may be formed in other various manners. For example, by separating the conveyor line in said position b or a predetermined position downstream of the position b and upstream of the position where the pooling zone is to be provided and making the conveying rate (the number of trucks which can be conveyed in a unit time) higher in the conveyor downstream of the position of the separation than in the conveyor upstream of the same so that a predetermined space is generated between successive two rotary trucks 22, the pooling zone 44 can be formed in the conveyor downstream of the position of the separation itself.

For example, the pooling zone may be formed by the second and third conveyors 26 and 28 themselves by separating the conveyor line between the first clear coating zone 38*a* and the second clear coating zone 38*b* as in the embodiment described above and making the conveying rate higher in the second and third conveyors 26 and 28 on the side of the second clear coating zone 38*b* than in the first conveyor 24 on the side of the first clear coating zone 38*a*. That is, when the conveying rate of the second and third conveyors 26 and 28 are higher than the first conveyor 24, a space between successive two rotary trucks 22 becomes larger on the second and third conveyors, 26 and 28 than on the first conveyor 24, and accordingly, when the rotary trucks 22 are put closer on the second and third conveyors 26 and 28, a certain space is formed on the conveyors 26 and 28. The space thus formed on the conveyors 26 and 28 can be used as a pooling zone 44.

Similarly, the pooling zone may be formed by the third conveyor 28 itself by separating the conveyor line on the side of the second clear coating zone 38*b* into a pair of conveyors (the second and third conveyors 26 and 28) in a predetermined position c downstream of the end of the pre-heat-hardening zone 42 (at the end of the pre-heat-hardening zone 42 in the embodiment described above) and making the conveying rate higher in the third conveyor 28 than in the second conveyor 26.

The pooling zone 44 should be able to accommodate at least the same number of rotary trucks 22 as that of the rotary trucks 22 in the second clear coating zone 38*b* so that the vehicle bodies 18 which have been applied with the coating composition to a thickness larger than the running limit thickness in the second clear coating zone 38*b* can be all conveyed out of the zone 38*b*.

Preferably the pooling zone 44 can accommodate at least the same number of rotary trucks 22 as the sum of the numbers of the rotary trucks 22 in the second clear coating zone 38*b* and the setting zone 40 so that the vehicle bodies 18 in the second clear coating zone 38*b* and the setting zone 40 all can be conveyed into or passed through the pre-heat-hardening zone 42, whereby a problem of dust or the like adhering to the coating film while the vehicle body 18 is rotated for a long time in the setting zone 40 can be avoided.

More preferably the pooling zone 44 can accommodate at least the same number of rotary trucks 22 as the sum of the numbers of the rotary trucks 22 in the second clear coating zone 38*b*, the setting zone 40 and the pre-heat-hardening zone 42 so that the vehicle bodies 18 in the second clear coating zone 38*b*, the setting zone 40 and the pre-heat-hardening zone 42 all can be passed through the pre-heat-hardening zone 42 and the pre-heat-hardening of the coating films on all the vehicle body 18 can be finished, whereby a problem of dust or the like adhering to the coating film can be more surely avoided.

The pooling zone 44 may be provided anywhere between the pre-heat-hardening zone 42 and the main heat-hardening zone 48. For example, the pooling zone 44 may be provided on the second non-rotary conveyor 14 between the second transfer means 52 and the main heat-hardening zone 48. In this case, the pooling zone 44 may be formed by connecting a separate conveyor to the second non-rotary conveyor 14 or by separating the conveyor line upstream of the position where the pooling zone 44 is to be provided and making the conveying rate higher in the conveyor downstream of the position of the separation than in the conveyor upstream of the same. In the latter case, the pooling zone 44 may be formed, for instance, by the second non-rotary conveyor 14 itself by making the conveying rate higher in the second non-rotary conveyor 14 than in the third conveyor 28.

Though, in this example, the pooling zone 44 is not effective when the second transfer means 52 fails, it is effective when trouble occurs in the main heat-hardening zone 48 or a part downstream thereof.

Another embodiment of the present invention

Figure 15:
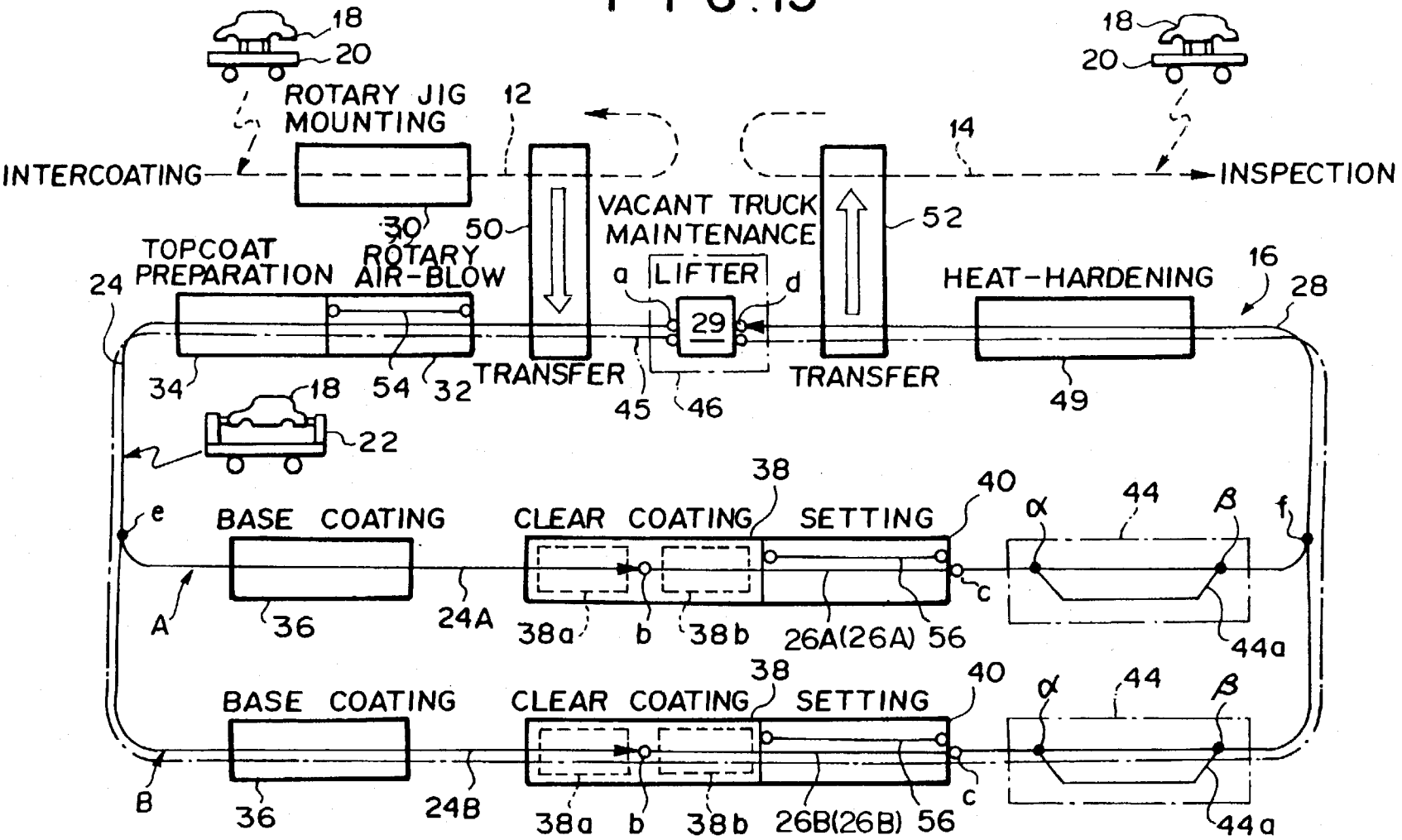
FIG. 15 is a schematic plan view of a plant or an apparatus in accordance with another embodiment of the present invention.

Another embodiment of the present invention will be described with reference to FIG. 15, hereinbelow. In this embodiment, the parts analogous to those in the embodiment described above are given the same reference numerals and will not be described in detail here.

The rotational coating plant of this embodiment basically the same in structure as that of the embodiment described above except that the pooling zone 44 is provided in a different position. That is, in this embodiment, on the assumption that the solvent in the coating composition applied to the work is evaporated in the setting zone 40 to such an extent that the coating composition cannot run or sag, the pooling zone 44 is disposed just downstream of the setting zone 40 between the setting zone 40 and the heat-hardening zone 49.

More particularly, the setting zone 40 is arranged to evaporate the solvent in the coating composition applied to the work to such an extent that the coating composition cannot run or sag. In other words, the setting time is set long enough to evaporate the solvent to such an extent as to bring the coating composition into the non-running state. Further the heat-hardening zone 49 comprises a single oven unlike in the embodiment described where the heat-hardening zone comprises the pre-heat-hardening zone and the main heat-hardening zone. Further the position of separation c between the second conveyor 26 and the third conveyor 28 of the rotary conveyor 16 is at the end of the setting zone 40. The heat-hardening zone 49 is provided on the third conveyor 28 and the pooling zone 44 is provided on the third conveyor 28 between the setting zone 40 and the heat-hardening zone 49.

In the case where the solvent in the coating composition applied to the work is evaporated in the setting zone 40 to such an extent that the coating composition cannot run or sag, the pooling zone 44 may be disposed just downstream of the setting zone 40. Also in this case, even if some trouble occurs in the second transfer means 52, the main heat-hardening zone 48, the inspecting zone and the subsequent assembly line, the vehicle body 18 which has been applied with the coating composition to the thickness larger than the running limit thickness in the second clear coating zone 38*b* can be conveyed out of the second clear coating zone 38*b* into the rotating zone, i.e., the setting zone 40 and rotated to prevent running or sagging of the coating composition by temporarily pooling the vehicle body 18 in the pooling zone 44.

In this embodiment, the pooling zone 44 is formed by connecting a sideline conveyor 44*a* to the third conveyor 28 at junctions α and β so that the rotary trucks 22 can be temporarily stayed on the sideline conveyor 44*a*. The pooling zone 44 may be formed in other various manners. For example, by separating the conveyor line in said position b or a predetermined position downstream of the position b and upstream of the position where the pooling zone is to be provided and making the conveying rate higher in the conveyor downstream of the position of the separation than in the conveyor upstream of the same so that a predetermined space is generated between successive two rotary trucks 22, the pooling zone 44 can be formed in the conveyor downstream of the position of the separation itself.

For example, the pooling zone may be formed by the second and third conveyors 26 and 28 themselves by separating the conveyor line between the first clear coating zone 38*a* and the second clear coating zone 38*b* as in the embodiment described above and making the conveying rate higher in the second and third conveyors 26 and 28 on the side of the second clear coating zone 38*b* than in the first conveyor 24 on the side of the first clear coating zone 38*a*.

Similarly, the pooling zone may be formed by the third conveyor 28 itself by separating the conveyor line on the side of the setting zone 40 into a pair of conveyors (the second and third conveyors 26 and 28) in a predetermined position c downstream of the end of the setting zone 40 (at the end of the setting zone 40 in this embodiment) and making the conveying rate higher in the third conveyor 28 than in the second conveyor 26.

The pooling zone 44 should be able to accommodate at least the same number of rotary trucks 22 as that of the rotary trucks 22 in the second clear coating zone 38*b* so that the vehicle bodies 18 which have been applied with the coating composition to a thickness larger than the running limit thickness in the second clear coating zone 38*b* can be all conveyed out of the zone 38*b*.

Preferably the pooling zone 44 can accommodate at least the same number of rotary trucks 22 as the sum of the numbers of the rotary trucks 22 in the second clear coating zone 38*b* and the setting zone 40 so that the vehicle bodies 18 in the second clear coating zone 38*b* and the setting zone 40 all can be passed through the setting zone 40 and the vehicle body 18 is not rotated for a long time in vain.

The heat-hardening zone 49 may comprise either a far-infrared oven or a hot-air oven or may comprise other ovens. The heat-hardening zone 49 may comprise a pre-heat-hardening zone and a main heat-hardening zone which are disposed apart from each other as in the embodiment described above. In this case, the pooling zone 44 is disposed between the setting zone 40 and the pre-heat-hardening zone. Further when the heat-hardening zone 49 comprises a pre-heat-hardening zone and a main heat-hardening zone which are disposed apart from each other, the pre-heat-hardening zone may comprise a far-infrared oven and may be disposed on the rotary conveyor 16 while the main heat-hardening zone may comprise a hot-air oven and may be disposed on the second non-rotary conveyor 14, though they may disposed both on the rotary conveyor 16. Further when the pooling zone 44 is not formed by the conveyor line itself, it need not be separated in the position c.

The vacant truck changing station 46 and the vacant truck maintenance station 45 are the same as those in the preceding embodiment.

Control of the state of the coating composition up to hardening

Control of the state of the clear coating composition from the time it is applied to the vehicle body to the time it hardens will be described, hereinbelow.

As described above, when by the rotational coating where the coating composition is applied to the work to a thickness larger than the running limit thickness and the work is rotated about a horizontal axis, an extremely smooth coating film surface can be obtained.

However, even by the rotational coating, the coating film surface cannot be always extremely smooth. Our investigation has revealed that even if the coating film surface is sufficiently smooth as shown at (c) in FIG. 4, the smoothness subsequently deteriorates when the solvent evaporates in a large amount after the coating composition loses its flowability. That is, when a large amount of solvent evaporates after the coating composition loses its flowability, the coating film shrinks by a large amount. When shrinkage of the coating film is large, the smoothness of the coating film is greatly affected by irregularities on the surface to be coated and the influence of the irregularities appears on the coating film surface as shown at (d) in FIG. 4. When shrinkage of the coating film is small, the influence of the irregularities hardly appears on the coating film surface as shown at (e) in FIG. 4.

More particularly, we found a fact that the smaller the shrinkage of the coating film after the coating composition loses its flowability due to evaporation of the solvent, reduction in viscosity of the solid component, and the like is, the less influence of the irregularities of the surface to be coated appears on the coating film surface, and the shrinkage of the coating film can be substantially determined by the amount of the solvent contained in the coating composition at the time the coating composition loses its flowability. When the amount of the solvent contained in the coating composition at the time the coating composition loses its flowability is not more than 30% by weight, influence of the irregularities on the surface to be coated can be avoided and the smoothness of the coating film surface can be better than that obtained by the conventional rotational coating. Further better smoothness of the coating film surface can be obtained when the amount of the solvent contained in the coating composition at the time the coating composition lose its flowability is not more than 10% by weight.

That is, as the shrinkage of the coating film after the coating composition loses its flowability increases, influence of the irregularities on the surface to be coated more appears on the coating film and vice versa. When influence of the irregularities once appears on the coating film after the coating composition lose its flowability, the irregularities on the coating film cannot be removed even if the work is continued to be rotated since the coating composition has lost its flowability.

Based on our discovery described above, in the embodiments described above, the coating composition is controlled so that the coating composition has a flowability and at the same time the proportion of the solvent is not more than 30% by weight (preferably 10% by weight) at a predetermined time in order to prevent influence of the irregularities on the surface to be coated from appearing on the coating film surface.

The expression that the coating composition has a flowability as used here means the coating composition has a flowability sufficient for the coating film surface to be smoothened by the surface tension and the like, and when the state in which the coating composition can run or sag 1 mm or more, the coating composition is said to have a flowability.

That is, when the coating film shrinks by a large amount and influence of the irregularities once appears on the coating film after the coating composition lose its flowability, the irregularities on the coating film cannot be removed since the coating composition has lost its flowability and the "self-smoothening ability" due to the surface tension. Accordingly the solvent must be reduced, while the coating composition has a flowability sufficient to exhibit the self-smoothening ability, to such an extent that the influence of the irregularities on the surface to be coated cannot appear on the coating film surface even if the coating film shrinks (i.e., not more than 30% by weight and preferably not more than 10% by weight). In order to ensure the self-smoothening ability, the flowability need not be so high as that at which the coating composition can run or sag but may be of such a value that the coating composition can run or sag 1 mm or more.

Said predetermined time may be any time up to the time the coating composition applied to a thickness larger than the limit thickness begins to harden. Accordingly, the coating composition may be controlled so that the coating composition has a flowability and at the same time the solvent accounts for not more than 30% (preferably 10%) by weight of the coating composition at a time during the setting step in the setting zone 40 or the end of the same or so that the coating composition has a flowability and at the same time the solvent accounts for not more than 30% (preferably 10%) by weight of the coating composition at a time during the heat-hardening step in the heat-hardening zone 49 (including the pre-heat-hardening zone 42). In the case where the temperature holding heating is effected, the coating composition may be controlled so that the coating composition has a flowability and at the same time the solvent accounts for not more than 30% (preferably 10%) by weight of the coating composition at a time during the temperature holding heating.

When the temperature holding step of holding the temperature of the coating composition at a predetermined temperature lower than the reaction starting temperature and higher than the ordinary temperatures for a predetermined time in the course of heating the coating composition to the reaction starting temperature is effected, more solvent can be evaporated while holding the flowability of the coating composition, whereby the amount of the solvent contained in the coating composition at the time the coating composition loses its flowability as compared with the ordinary heat-hardening zone where the temperature of the coating composition is linearly increased to the reaction starting temperature and a very excellent smoothness of the coating film surface can be obtained hardly affected by the irregularities on the surface to be coated. More particularly, in the ordinary heat-hardening zone, the temperature in the heating oven is set not lower than the reaction starting temperature of the coating composition and the temperature of the coating composition increases at a rate depending on the heat capacity of the work.

When the temperature of the coating composition increases in such a manner, the temperature of the coating composition reaches to the reaction starting temperature in a short time and the viscosity of the coating composition increases (the flowability lowers) due to reaction-hardening. Accordingly, it is difficult to reduce the amount of the solvent not lower than 10% by weight while keeping the flowability. To the contrast, when the temperature holding step is carried out, a sufficient amount of solvent can be evaporated without permitting the coating composition to reaction-harden, whereby the amount of the solvent can be easily reduced not lower than 10% by weight while keeping the flowability and a very excellent smoothness which cannot be obtained but the temperature holding step can be obtained.

When the solvent is to be reduced to a given level, the purpose can be accomplished in a shorter time by effecting the temperature holding step, whereby the time required for the heat-hardening step can be shortened.

The control of the coating composition is effected by adjusting the kind of the coating composition, the kind and/or the amount of the solvent, the coating thickness, the setting condition, the pre-heat-hardening condition and/or the like.

In order to obtain a sufficient smoothness of the coating film surface without being affected by the irregularities on the surface to be coated, it is necessary that the coating composition loses its flowability in a state where the coating film surface is given a sufficient smoothness by virtue of the rotational coating and the solvent accounts for not more than 30% by weight (preferably not more than 10% by weight) of the coating composition at the time the coating composition loses its flowability.

Since the rotational coating is to obtain a sufficient smoothness of the coating film surface by rotating the work until the coating composition sets at least to such an extent that the coating composition cannot run or sag, the coating film surface necessarily has a sufficient smoothness at the time the coating composition loses its flowability irrespective whether the coating composition loses its flowability during rotation of the work or after rotation of the work is ended. Even if the coating composition has a flowability at the end of rotation, the flowability of the coating composition is very small and the coating composition cannot run or sag more than 2 mm. Accordingly, the smoothness of the coating film surface obtained by rotation of the work can be kept until the coating composition loses its flowability.

Thus, in the rotational coating, when the coating composition has a flowability and at the same time the solvent accounts for not more than 30% or 10% by weight of the coating composition at a time during rotation of the work, the solvent necessarily accounts for not more than 30% or 10% by weight of the coating composition and the coating film surface necessarily has a sufficient smoothness at the time the coating composition loses its flowability. Accordingly that the coating composition has a flowability and at the same time the solvent accounts for not more than 30% or 10% by weight of the coating composition at a time during rotation of the work is substantially equivalent to that the coating composition loses its flowability in a state where the coating film surface has a sufficient smoothness and the solvent accounts for not more than 30% or 10% by weight of the coating composition at the time the coating composition loses its flowability.

What is claimed is:

1. In a coating apparatus comprising a coating station including a plurality of coating zones for applying a solvent-containing thermosetting coating composition to a work, said plurality of coating zones including a final coating zone for applying the coating composition to a thickness larger than a limit thickness over which the coating composition on a surface of the work extending in a vertical direction will normally run or sag, a heat-hardening station including a heat-hardening zone for hardening the coating composition applied to the work by heating, a rotating means for rotating the work about a substantially horizontal axis after the coating in the coating zone to prevent the coating composition on the vertical surface of the work from running or sagging, and a conveyor means for passing the work through the coating zone and the heat-hardening zone in this order, the conveyor means including a pair of conveyors which form a conveyor line for conveying the work and are separated from each other upstream of a position where the coating composition is applied to the work to a thickness larger than said limit thickness, and said heat-hardening zone including a pre-heat-hardening zone for half hardening the coating composition to such an extent that the coating composition cannot run or sag and a main heat-hardening zone for fully hardening the coating composition after the coating composition is half hardened, wherein the improvement comprises that a pooling station including a pooling zone in which a predetermined number of works are temporarily pooled is provided between the pre-heat-hardening zone and the main heat-hardening zone, said pooling zone having a storage capacity equal to at least the sum of the number of works in the final coating zone and present in the pre-heat-hardening zone, wherein at least the final coating zone, the pre-heat-hardening and the pooling zone are formed on at least one conveyor, the coating zones other than the final coating zone and the main heat-hardening zone being formed on conveyor sections which operate independently from said at least one conveyor.

2. A coating apparatus as defined in claim 1 in which the work is passed through the coating zone and the pre-heat-hardening zone in this order by a rotary conveyor which conveys the work on a rotary truck which carries the work supporting it for rotation, and the work is passed through the main heat-hardening zone by a non-rotary conveyor which conveys the work on a non-rotary truck which carries the work holding it stationary, and a transfer means for transferring the work on the rotary truck on the rotary conveyor to the non-rotary truck on the non-rotary conveyor is provided between the pre-heat-hardening zone and the main heat-hardening zone, said pooling zone being provided between the pre-heat-hardening zone and the transfer means.

3. A coating apparatus as defined in claim 2 in which said rotary conveyor is formed in an endless fashion.

4. A coating apparatus as defined in claim 1 in which the work is passed through the coating zone and the pre-heat-hardening zone in this order by a rotary conveyor which conveys the work on a rotary truck which carries the work supporting it for rotation, and the work is passed through the main heat-hardening zone by a non-rotary conveyor which conveys the work on a non-rotary truck which carries the work holding it stationary, and a transfer means for transferring the work on the rotary truck on the rotary conveyor to the non-rotary truck on the non-rotary conveyor is provided between the pre-heat-hardening zone and the main heat-hardening zone, said pooling zone being provided between the transfer means and the main heat-hardening zone.

5. A coating apparatus as defined in claim 4 in which said rotary conveyor is formed in an endless fashion.

6. A coating apparatus as defined in claim 1 in which said conveyor line is separated into an upstream side conveyor line and a downstream side conveyor line, the conveying rate being higher in the downstream side conveyor line than in the upstream side conveyor line and said pooling zone being provided on the downstream side conveyor line itself by virtue of the difference in the conveying rate.

7. A coating apparatus as defined in claim 1 in which a setting station including a setting zone for effecting setting of evaporating the solvent in the coating composition applied to the work is provided between the coating zone and th preheat-hardening zone.

8. A coating apparatus as defined in claim 7 in which said pooling zone accommodates at least the same number of works as the sum of the numbers of the works in the setting zone and a part of the coating zone where the coating composition is applied to the work to a thickness larger than said limit thickness.

9. A coating apparatus as defined in claim 7 in which said pooling zone accommodates at least the same number of works as the sum of the numbers of the works in a part of the coating zone where the coating composition is applied to the work to a thickness larger than said limit thickness, the setting zone and the pre-heat-hardening zone.

10. A coating apparatus as defined in claim 1 in which said pooling zone accommodates at least the same number of works as that of the works in a part of the coating zone where the coating composition is applied to the work to a thickness larger than said limit thickness.

11. A coating apparatus as defined in claim 1 in which said coating zone comprises a plurality of zones and the coating composition is applied to the work to a thickness larger than said limit thickness in the final zone.

12. A coating apparatus as defined in claim 1, wherein the coating zones other than the final coating zone and the main heat-hardening zone are formed on conveyors different from said at least one conveyor.

13. In a coating apparatus comprising a coating station including a plurality of coating zones for applying a solvent-containing thermosetting coating composition to a work, said plurality of coating zones including a final coating zone for applying the coating composition to a thickness larger than a limit thickness over which the coating composition on a surface of the work extending in a vertical direction will normally run or sag, a setting station including a setting zone for effecting setting of evaporating the solvent in the coating composition applied to the work to such an extent that the coating composition cannot run or sag, a heat-hardening station including a heat-hardening zone for hardening the coating composition applied to the work by heating after the setting in the setting zone, a rotating means for rotating the work about a substantially horizontal axis after the coating in the coating zone to prevent the coating composition on the vertical surface of the work from running or sagging, and a conveyor means for passing the work through the coating zone, the setting zone and the heat-hardening zone in this order, the conveyor means including a pair of conveyors which form a conveyor line for conveying the work and are separated from each other upstream of a position where the coating composition is applied to the work to a thickness larger than said limit thickness, wherein the improvement comprises that a pooling station including a pooling zone in which a predetermined number of works are temporarily pooled is provided between the setting zone and the heat-hardening zone, said pooling zone having a storage capacity equal to at least the sum of the number of works in the final coating zone and present in the setting zone, wherein at least the final coating zone, the setting and the pooling zone are formed on at least one conveyor, the coating zones other than the final coating zone and the main heat-hardening zone being formed on conveyor sections which operate independently from said at least one conveyor.

14. A coating apparatus as defined in claim 13 said conveyor means comprises a rotary conveyor which conveys the work on a rotary truck which carries the work supporting it for rotation and said rotating means comprises a rotation transmitting mechanism provided on the rotary truck and a sub conveyor which is provided along the rotary conveyor to provide rotation to the rotation transmitting mechanism.

15. A coating apparatus as defined in claim 13 in which said conveyor line is separated into an upstream side conveyor line and a downstream side conveyor line, the conveying rate being higher in the downstream side conveyor line than in the upstream side conveyor line and said pooling zone being provided on the downstream side conveyor line itself by virtue of the difference in the conveying rate.

16. A coating apparatus as defined in claim 13 in which said pooling zone accommodates at least the same number of works as the number of the works in a part of the coating zone where the coating composition is applied to the work to a thickness larger than said limit thickness.

17. A coating apparatus as defined in claim 13 in which said pooling zone accommodates at least the same number of works as the sum of the numbers of the works in the setting zone and a part of the coating zone where the coating composition is applied to the work to a thickness larger than said limit thickness.

18. A coating apparatus as defined in claim 13 in which said coating zone comprises a plurality of zones and the coating composition is applied to the work to a thickness larger than said limit thickness in the final zone.

19. A coating apparatus as defined in claim 13, wherein the coating zones other than the final coating zone and the main heat-hardening zone are formed on conveyors different from said at least one conveyor.

20. In a coating apparatus comprising a coating station including a plurality of coating zones for applying a solvent-containing thermosetting coating composition to a work, said plurality of coating zones including a final coating zone for applying the coating composition to a thickness larger than a limit thickness over which the coating composition on a surface of the work extending in a vertical direction will normally run or sag, a heat-hardening station including a heat-hardening zone for hardening the coating composition applied to the work by heating, and a conveyor means for passing the work through the coating zone and the heat-hardening zone in this order to prevent the coating composition on the vertical surface of the work from running or sagging, the conveyor means including a pair of conveyors which form a conveyor line for conveying the work and are separated from each other upstream of a position where the coating composition is applied to the work to a thickness larger than said limit thickness, and said heat-hardening zone including a pre-heat-hardening zone for half hardening the coating composition to such an extent that the coating composition cannot run or sag and a main heat-hardening zone for fully hardening the coating composition after the coating composition is half hardened, wherein the improvement comprises that a pooling station including a pooling zone in which a predetermined number of works are temporarily pooled is provided between the pre-heat-hardening zone and the main heat-hardening zone, said pooling zone having a storage capacity equal to at least the sum of the number of works in the final coating zone and present in the pre-heat-hardening zone, wherein at least the final coating zone, the pre-heat-hardening and the pooling zone are formed on at least one conveyor, the coating zones other than the final coating zone and the main heat-hardening zone being formed on conveyor sections which operate independently from said at least one conveyor.

21. A coating apparatus as defined in claim 20 in which said conveyor line is separated into an upstream side conveyor line and a downstream side conveyor line, the conveying rate being higher in the downstream side conveyor line than in the upstream side conveyor line and said pooling zone being provided on the downstream side conveyor line itself by virtue of the difference in the conveying rate.

22. A coating apparatus as defined in claim 20 in which said pooling zone accommodates at least the same number of works as that of the works in a part of the coating zone where the coating composition is applied to the work to a thickness larger than said limit thickness.

23. A coating apparatus as defined in claim 20, wherein the coating zones other than the final coating zone and the main heat-hardening zone are formed on conveyors different from said at least one conveyor.

24. In a coating apparatus comprising a coating station including a plurality of coating zones for applying a solvent-containing thermosetting coating composition to a work, said plurality of coating zones including a final coating zone for applying the coating composition to a thickness larger than a limit thickness over which the coating composition on a surface of the work extending in a vertical direction will normally run or sag, a setting station including a setting zone for effecting setting of evaporating the solvent in the coating composition applied to the work to such an extent that the coating composition cannot run or sag, a heat-hardening station including heat-hardening zone for hardening the coating composition applied to the work by heating after the setting in the setting zone, and a conveyor means for passing the work through the coating zone, the setting zone and the heat-hardening zone in this order, the conveyor means to prevent the coating composition on the vertical surface of the work from running or sagging including a pair of conveyors which form a conveyor line for conveying the work and are separated from each other upstream of a position where the coating composition is applied to the work to a thickness larger than said limit thickness, wherein the improvement comprises that a pooling station including a pooling zone in which a predetermined number of works are temporarily pooled is provided between the setting zone and the main heat-hardening zone, said pooling zone having a storage capacity equal to at least the sum of the number of works in the final coating zone and present in the setting zone, wherein at least the final coating zone, the setting zone and the pooling zone are formed on at least one conveyor, the coating zones other than the final coating zone and the main heat-hardening zone being formed on conveyor sections which operate independently from said at least one conveyor.

25. A coating apparatus as defined in claim 24 in which said pooling zone accommodates at least the same number of works as the number of the works in a part of the coating zone where the coating composition is applied to the work to a thickness larger than said limit thickness.

26. A coating apparatus as defined in claim 24 in which said pooling zone accommodates at least the same number of works as the sum of the numbers of the works in the setting zone and a part of the coating zone where the coating composition is applied to the work to a thickness larger than said limit thickness.

27. A coating apparatus as defined in claim 24, wherein the coating zones other than the final coating zone and the main heat-hardening zone are formed on conveyors different from said at least one conveyor.

* * * * *